US009026283B2

(12) United States Patent
Baldwin et al.

(10) Patent No.: US 9,026,283 B2
(45) Date of Patent: May 5, 2015

(54) TRAIN DETECTION

(75) Inventors: David E. Baldwin, Madison, WI (US); Ahtasham Ashraf, Lewis Center, OH (US)

(73) Assignee: Central Signal, LLC, Madison, WI (US)

( * ) Notice: Subject to any disclaimer, the term of this patent is extended or adjusted under 35 U.S.C. 154(b) by 0 days.

(21) Appl. No.: 13/699,549

(22) PCT Filed: May 30, 2011

(86) PCT No.: PCT/US2011/038481

§ 371 (c)(1),
(2), (4) Date: Nov. 21, 2012

(87) PCT Pub. No.: WO2011/153114

PCT Pub. Date: Dec. 8, 2011

(65) Prior Publication Data

US 2013/0062474 A1 Mar. 14, 2013

Related U.S. Application Data

(60) Provisional application No. 61/350,000, filed on May 31, 2010, provisional application No. 61/349,999, filed on May 31, 2010, provisional application No. 61/358,374, filed on Jun. 24, 2010.

(51) Int. Cl.
*G05D 1/00* (2006.01)
*G05D 3/00* (2006.01)
(Continued)

(52) U.S. Cl.
CPC ..... *B61L 29/282* (2013.01); *Y02B 60/50* (2013.01)

(58) Field of Classification Search
USPC ..... 701/19, 25; 246/122 R, 130, 292; 340/941
See application file for complete search history.

(56) References Cited

U.S. PATENT DOCUMENTS 847,105 A 3/1907 Parrish, Jr.
2,664,499 A 12/1953 Muse
(Continued)

FOREIGN PATENT DOCUMENTS

DE 195 32 640 A1 2/1997
DE 10 2004 035 901 A1 3/2006
(Continued)

OTHER PUBLICATIONS

Michael J. Caruso et al., Vehicle Detection and Compass Applications using AMR Magnetic Sensors, May 1999, Honeywell.*
(Continued)

*Primary Examiner* — Tuan C. To
*Assistant Examiner* — Isaac Smith
(74) *Attorney, Agent, or Firm* — K&L Gates LLP

(57) ABSTRACT

Occupancy of a railroad track detection zone by one or more trains is determined using sensor devices located at gateways into and out of the track detection zone. Each sensor device has a sensing range that includes a portion of the railroad track in the detection zone and the sensor device generates data used to uniquely identify each train passing through a gateway and thus the sensing range of one or more sensor devices. Data from the detection zone's sensor device array is collected and evaluated to monitor or track the status of any detected trains and the occupancy of the zone. In some embodiments, the sensor devices utilize anisotropic magnetoresistive sensor elements whose analog waveform data is the basis of magnetic flux peak detection and mapping to generate unique train identification signature data that is transmitted to and evaluated by a detection zone processor, which in some cases can control crossing signals and/or other control apparatus related to the railroad track detection zone. The unique train identification signature data can include digitized amplitude peaks and their sequence for each train, based on that train's generated analog waveform data.

20 Claims, 13 Drawing Sheets

(51) Int. Cl.

| | |
|---|---|
| ***G06F 7/00*** | (2006.01) |
| ***G06F 17/00*** | (2006.01) |
| ***B61L 29/28*** | (2006.01) |

(56) References Cited

U.S. PATENT DOCUMENTS

| | | | | |
|---|---|---|---|---|
| 3,810,119 | A | 5/1974 | Zieve et al. | |
| 3,816,796 | A | 6/1974 | Molloy et al. | |
| 3,974,991 | A | 8/1976 | Geiger | |
| 4,103,303 | A | 7/1978 | Regenos et al. | |
| 4,196,412 | A | 4/1980 | Sluis et al. | |
| 4,250,483 | A | 2/1981 | Rubner | |
| 4,251,041 | A | 2/1981 | Svet | |
| 4,307,860 | A | 12/1981 | Kuhn | |
| 4,324,376 | A | 4/1982 | Kuhn | |
| 4,361,301 | A | 11/1982 | Rush | |
| 4,365,777 | A | 12/1982 | Geiger | |
| 4,449,115 | A | 5/1984 | Koerner | |
| 4,581,700 | A | 4/1986 | Farnham et al. | |
| 4,703,303 | A | 10/1987 | Snee | |
| 4,711,418 | A | 12/1987 | Aver, Jr. et al. | |
| 4,727,372 | A | 2/1988 | Buttemer | |
| 4,787,581 | A | 11/1988 | Dobler et al. | |
| 4,906,979 | A | 3/1990 | Kimura | |
| 4,934,633 | A | 6/1990 | Ballinger et al. | |
| 5,006,847 | A | 4/1991 | Rush et al. | |
| 5,050,823 | A | 9/1991 | Parker | |
| 5,098,044 | A | 3/1992 | Petit et al. | |
| 5,153,525 | A | 10/1992 | Hoekman et al. | |
| 5,278,555 | A | 1/1994 | Hoekman | |
| 5,281,965 | A | 1/1994 | Hoekman et al. | |
| 5,361,064 | A | 11/1994 | Hamer et al. | |
| 5,417,388 | A | 5/1995 | Stillwell | |
| 5,437,422 | A | 8/1995 | Newman | |
| 5,491,475 | A | 2/1996 | Rouse et al. | |
| 5,504,860 | A | 4/1996 | George et al. | |
| 5,508,698 | A | 4/1996 | Hoekman | |
| 5,590,855 | A | 1/1997 | Kato et al. | |
| 5,620,155 | A | 4/1997 | Michalek | |
| 5,734,338 | A | 3/1998 | Hoekman et al. | |
| 5,737,173 | A | 4/1998 | Ross et al. | |
| 5,751,225 | A | 5/1998 | Fedde et al. | |
| 5,850,192 | A | 12/1998 | Turk et al. | |
| 5,868,360 | A | 2/1999 | Bader et al. | |
| 5,924,652 | A | 7/1999 | Ballinger | |
| 5,954,299 | A | 9/1999 | Pace | |
| 6,061,809 | A * | 5/2000 | Glaser et al. | 714/11 |
| 6,232,887 | B1 | 5/2001 | Carson | |
| 6,241,197 | B1 | 6/2001 | Harland | |
| 6,290,187 | B1 | 9/2001 | Egami | |
| 6,292,112 | B1 * | 9/2001 | Bader et al. | 340/941 |
| 6,342,845 | B1 | 1/2002 | Hilliard et al. | |
| 6,386,486 | B1 | 5/2002 | Speranza | |
| 6,457,682 | B2 | 10/2002 | Anderson et al. | |
| 6,519,512 | B1 | 2/2003 | Haas et al. | |
| 6,604,031 | B2 | 8/2003 | Oguma et al. | |
| 6,641,091 | B1 | 11/2003 | Hilleary | |
| 6,683,540 | B1 | 1/2004 | Harrison | |
| 6,688,561 | B2 | 2/2004 | Mollet et al. | |
| 6,799,097 | B2 | 9/2004 | Villarreal Antelo et al. | |
| 6,828,920 | B2 | 12/2004 | Owen et al. | |
| 6,828,956 | B2 | 12/2004 | Notagashira | |
| 6,829,526 | B2 | 12/2004 | Oguma et al. | |
| 7,075,427 | B1 | 7/2006 | Pace et al. | |
| 7,254,467 | B2 | 8/2007 | Fries et al. | |
| 7,296,770 | B2 | 11/2007 | Franke | |
| 7,411,521 | B2 * | 8/2008 | Lewis et al. | 341/32 |
| 7,548,032 | B2 | 6/2009 | Alton et al. | |
| 7,575,202 | B2 | 8/2009 | Sharkey et al. | |
| 7,577,502 | B1 | 8/2009 | Henry et al. | |
| 7,626,384 | B2 * | 12/2009 | Hinz | 324/252 |
| 8,493,237 | B2 * | 7/2013 | Grievink et al. | 340/932.2 |
| 2001/0022332 | A1 | 9/2001 | Harland | |
| 2002/0049520 | A1 | 4/2002 | Mays | |
| 2002/0177942 | A1 | 11/2002 | Knaian et al. | |
| 2002/0185571 | A1 | 12/2002 | Bryant et al. | |
| 2004/0088923 | A1 | 5/2004 | Burke | |
| 2004/0119587 | A1 | 6/2004 | Davenport et al. | |
| 2004/0130463 | A1 | 7/2004 | Bloomquist et al. | |
| 2004/0181321 | A1 | 9/2004 | Fries et al. | |
| 2004/0201486 | A1 | 10/2004 | Knowles et al. | |
| 2004/0249571 | A1 | 12/2004 | Blesener et al. | |
| 2004/0261533 | A1 | 12/2004 | Davenport et al. | |
| 2005/0137759 | A1 | 6/2005 | Peltz et al. | |
| 2005/0194497 | A1 | 9/2005 | Matzan | |
| 2005/0237215 | A1 | 10/2005 | Hatfield et al. | |
| 2005/0284987 | A1 | 12/2005 | Kande et al. | |
| 2006/0272539 | A1 | 12/2006 | Clavel | |
| 2007/0129858 | A1 | 6/2007 | Herzog et al. | |
| 2007/0146152 | A1 | 6/2007 | Welles et al. | |
| 2007/0162218 | A1 * | 7/2007 | Cattin et al. | 701/117 |
| 2007/0276600 | A1 | 11/2007 | King et al. | |
| 2008/0169385 | A1 * | 7/2008 | Ashraf et al. | 246/130 |
| 2008/0258716 | A1 * | 10/2008 | Hinz | 324/207.21 |
| 2009/0326746 | A1 * | 12/2009 | Mian | 701/19 |
| 2010/0108823 | A1 | 5/2010 | Barnes | |
| 2013/0062474 | A1 * | 3/2013 | Baldwin et al. | 246/122 R |
| 2013/0063282 | A1 * | 3/2013 | Baldwin et al. | 340/941 |

FOREIGN PATENT DOCUMENTS

| | | | |
|---|---|---|---|
| DE | 20 2005 020 802 | U1 | 3/2007 |
| EP | 1 832 849 | A2 | 9/2007 |
| JP | 4321467 | | 11/1992 |
| JP | 10006994 | A | 1/1998 |
| JP | 2003002207 | | 1/2003 |
| KR | 10-0688090 | B1 | 3/2007 |
| WO | WO 97/25235 | | 7/1997 |
| WO | WO 2006/051355 | A1 | 5/2006 |
| WO | WO 2008/080169 | A1 | 7/2008 |
| WO | WO 2008/080175 | A2 | 7/2008 |

OTHER PUBLICATIONS

Bin Pei et al., An embedded Fail-Safe Interlocking System, IEEE, 1997.*

Valentine T. Jordan et al., Digital Peak Detector with Noise Threshold, IEEE, 2003.*

Wheatstone Bridge, http://en.wikipedia.org/wiki/Wheatstone bridge, obtained from website May 1, May 25, 2006 (3 pgs).

Wheatstone Bridge, "Measure an Unknown Resistance," www.dwiarda.com/scientific/Bridge.html, obtained from website May 1, May 25, 2006 (1 pg).

Chandra, V and Verma, M. R., "A fail-safe interlocking system for railways," Design & Test of Computers, (Jan./Mar. 1991), 8(1):58-66 abstract only (1 pg).

Honeywell, "1- and 2-axis magnetic sensors: HMC1001/1002; HMC1021/1022," Apr. 2000, pp. 1-15 (15 pgs).

3M, "Canoga Vehicle Detection System, Advanced Traffic Products: The solution beneath the surface," obtained from Internet at: www.advancedtraffic.com/3mcanoga-pl.htm, Sep. 27, 2005 (4 pgs).

3M, "Canoga Vehicle Detection System: A matched component system for vehicle counting," 3M Intelligent Transportation Systems, 1998 (2 pgs).

3M, "Canoga Vehicle Detection System: Non-invasive Microloop model 702," 3M Intelligent Transportation Systems, 1997 (4 pgs).

3M, Canoga Vehicle Detection System, list of products, obtained from Internet at: http://products3.3m.com/catalog/us/en001/safety/traffic_control/nod_GSTYGYSDV5be/r . . . , Sep. 27, 2005 (2 pgs).

3M, Canoga Vehicle Detection System: C800 interface and data acquisition software (C800 IS), and C800 vehicle detectors, (product features), 3M Intelligent Transportation Systems, date unknown (7 pgs).

Trafinfo Communications, Inc., "Trafmate 6: Wireless telemetry for traffic monitoring," date unknown (2 pgs).

Notification of Transmittal of the International Search Report and the Written Opinion of the International Searching Authority for International Application No. PCT/US2011/038481; KIPO mailing date Jan. 11, 2012 (2 pgs).

(56) References Cited

OTHER PUBLICATIONS

International Search Report, International Application No. PCT/US2011/038481; KIPO mailing date Jan. 11, 2012 (3 pgs).
Written Opinion of the International Searching Authority, International Application No. PCT/US2011/038481; KIPO mailing date Jan. 11, 2012 (5 pgs).
Notification of Transmittal of the International Search Report and the Written Opinion of the International Searching Authority for International Application No. PCT/US2011/038482; KIPO mailing date Jan. 13, 2012 (2 pgs).
International Search Report, International Application No. PCT/US2011/038482; KIPO mailing date Jan. 13, 2012 (3 pgs).
Written Opinion of the International Searching Authority, International Application No. PCT/US2011/038482; KIPO mailing date Jan. 13, 2012 (5 pgs).
Brawner, J., et al.; "Magnetometer Sensor Feasibility for Railroad and Highway Equipment Detection;" Innovations Deserving Exploratory Analysis Programs—High-Speed Rail Idea Program; Transportation Research Board of the National Academies; Jun. 24, 2006; Publication date Jun. 2008 (33 pgs).
Notification of Transmittal of the International Search Report and the Written Opinion of the International Searching Authority for International Application No. PCT/US2007/088849 (1 pg).
International Search Report, International Application No. PCT/US2007/088849 (2 pgs).
Written Opinion of the International Searching Authority, International Application No. PCT/US2007/088849 (6 pgs).
Notification of Transmittal of the International Search Report and the Written Opinion of the International Searching Authority for International Application No. PCT/US2008/051099 (1 pg).
International Search Report, International Application No. PCT/US2008/051099 (3 pgs).
Written Opinion of the International Searching Authority, International Application No. PCT/US2008/051099 (5 pgs).
Extended European Patent Office Search Report, EPO Application No. 08 727 699.4 (5 pgs).
Extended European Patent Office Search Report, EPO Application No. 07 866 027.1 (10 pgs).
EPO Machine Translation of DE 195 32 640 A1 (6 pages).
EPO Machine Translation of DE 10 2004 035 901 A1 (5 pages).
Caruso, M. et al, "Vehicle Detection and Compass Applications using AMR Magnetic Sensors," www.ssec.honeywell.com (13 pgs).
Honeywell, "Application Note—AN218—Vehicle Detection Using AMR Sensors," www.honeywell.com, Aug. 2005 (10 pgs).
Honeywell, "Smart Digital Magnetometer," www.magneticsensors.com, 900139, Feb. 2004 Rev. H (12 pgs).
Safety Now, "Allen-Bradley 6556 Micrologix Clutch/Brake Controller for Mechanical Stamping Presses," Apr. 2001, www.ab.com/safety/safety_now/april01, obtained from website May 25, 2006 (4 pgs).
Safety Now, "Back to School," article by Frank Watkins and Steve Dukich, www.ab.com/safety/safety_now/april01/back_school, obtained from website May 25, 2006 (4 pgs).
Wheatstone Bridge, www.geocities.com/CapeCanaveral/8341/bridge.htm?20061, obtained from website May 1, May 25, 2006 (1 pg).

* cited by examiner

```
PeakDetection(Z, δ)
mx ← - ∞
mn ← +∞
p[] ← new
searchmaxima ← 0
for i = 1; i≤ n; i++ do
    if z_i > mx + δ, then
        mx ← z_i
    end if
    if z_i < mx - δ, then
        mn ← z_i
    end if
    if searchmaxima == 1 then
        if z_i < mx - δ, then
            p_i ← z_i
            mn ← z_i
            searchmaxima ← 0
        end if
    else
        if z_i > mn + δ, then
            p_i = ← z_i,
            mx = ← z_i
            searchmaxima ← 1
        end if
    end if
end for
return p
```

FIG. 9

FindMatch($P_1$, $P_2$, $w$, $D$, $\theta 1$, $\theta 2$, $\theta 3$)

```
n ← max(|P1|,|P2|)
diff ← 0
matchfound ← 0
LessThanθ1 ← 0
LessThanθ2 ← 0
LessThanθ3 ← 0
for i=1; i ≤ n; i++ do
    diff ← D(w(i+1,1),w(i+1,2)) - D(w(i,1),w(i,2))
    if ( diff < θ1 ) then
        LessThanθ1 ← LessThanθ1 + 1
        LessThanθ2 ← 0
        LessThanθ3 ← 0
    elseif ( diff < θ2 ) then
        LessThanθ2 ← LessThanθ2 + 1
        LessThanθ1 ← 0
        LessThanθ3 ← 0
    elseif ( diff < θ3 ) then
        LessThanθ3 ← LessThanθ3 + 1
        LessThanθ1 ← 0
        LessThanθ2 ← 0
    end if
    if (LessThanθ1 == 2) then
        matchfound ← 1
        break
    end if
    if(LessThanθ2 == 3) then
        matchfound ← 1
        break
    end if
    if (LessThanθ3 == 4) then
        matchfound ← 1
        break
    end if
    end for
    return matchfound
```

FIG. 10

TRAIN DETECTION

PRIORITY CLAIMS AND CROSS-REFERENCE TO RELATED APPLICATIONS

This patent application claims the benefit of and priority to the following prior filed U.S. provisional patent applications, each of which is incorporated herein by reference in its entirety for all purposes:

- U.S. Provisional Application No. 61/350,000 filed May 31, 2010, entitled "TRAIN DETECTION" by Baldwin et al., including all Appendices;
- U.S. Provisional Application No. 61/358,374 filed Jun. 24, 2010, entitled "TRAIN DETECTION" by Baldwin et al., including all Appendices;
- U.S. Provisional Application No. 61/349,999 filed May 31, 2010, entitled "ROADWAY DETECTION" by Baldwin et al., including all Appendices.

STATEMENT REGARDING FEDERALLY SPONSORED RESEARCH OR DEVELOPMENT

The invention disclosed and claimed herein was supported, in whole or in part, by Contract/Grant Numbers USDA SBIR 1 2006-33610-16783 & USDA SBIR 2 2007-33610-18611 from the United States Department of Agriculture. The United States Government may have certain rights in the invention in whole or in part.

One or more inventions in U.S. Provisional Application No. 61/349,999 filed May 31, 2010, entitled ROADWAY DETECTION, were supported, in whole or in part, by Contract/Grant Numbers USDOT Phase 1 DTRT57-08-C-10010 & USDOT Phase 2 DTRT57-09-C-10034 from the United States Department of Transportation. The United States Government may have certain rights in an invention of that application in whole or in part.

This application is related to the following co-pending cases, each of which is incorporated herein by reference in its entirety for all purposes:

- PCT International Application No. PCT/US2011/038482, entitled "ROADWAY DETECTION" by Baldwin et al., filed on even date herewith, May 30, 2011;
- U.S. Ser. No. 11/964,606 , filed Dec. 26, 2007, published Jul. 31, 2008 as United States Publication No. 2008/0183306 A1, entitled "VITAL SOLID STATE CONTROLLER" by Ashraf et al.;
- U.S. Ser. No. 12/014,630, filed Jan. 15, 2008, published Jul. 17, 2008 as United States Publication No. 2008/0169385 A1, entitled "VEHICLE DETECTION SYSTEM" by Ashraf et al.

TECHNICAL FIELD

Embodiments of the present invention relate generally to systems, apparatus, methods, techniques and the like for detection of trains and like vehicles in rail-based systems and the like. More specifically, the present disclosure relates generally to systems, apparatus, methods, etc. for collecting and evaluating train detection data, in some cases in connection with larger systems—for example, railroad signal systems for controlling train operation, highway crossing signal systems for warning motorists of conflicts with trains, switching and classification yards for assembling trains, non-signaled applications to provide information about track switches, train movements on adjacent tracks, vehicle intrusions into track clearance zones, highway traffic control systems at intersections near railroad crossings, positive train control systems, traffic prediction and management systems, and the like.

BACKGROUND

Train detection is the fundamental task of railroad signal and other systems. All other functions of a railroad signal system depend upon the system's ability to always and reliably detect a train moving within the limits of the system. The system must guarantee that a train moving within the limits of the system will be detected. Moreover, the system must be designed to verify that it is functioning as intended. In the event that an element of the system cannot perform its intended function, the system must revert to its safest condition. Information provided to train crews and motor vehicles by a signal system when it is at its safest or most restrictive condition is the message "STOP." Signal engineers call devices and systems that incorporate these design requirements vital devices and describe them as fail-safe, meaning that they revert to their safest condition when they fail to or are unable perform their intended function. A fundamental principle of vital design for signal system electrical circuits is the closed circuit principle, which requires that the power source and return connections to an electrical device must be isolated and separate and any intervening control points within the circuit must treat both paths of the energy circuit. This assures that disruption/failure of either path will not violate the fail-safe principle. This essence of the closed circuit principle is that any element of a vital circuit must function separately and independently from other circuit elements—vital circuits may not share circuit elements that afford alternative energy or logic paths that would allow the system to violate the fail-safe principle. Microprocessor-based signal system elements satisfy the closed circuit principle by using hardware that is operationally independent and application logic that requires redundant and independent processing of all data necessary to the fail-safe operation of the device. If the direct physical connection cannot comply with the closed circuit principle, it must comply with a vital communications protocol. A vital communications protocol can be used to verify the integrity and operational status of the elements of the communication means. Verification must be sufficient to ensure that, in the event of a communications failure, the communicating devices will not violate the fail-safe principle.

Apparatus, methods, systems, techniques, etc. that provide vital, reliable, and efficient train detection that is independent of the track structure would represent a significant advancement in the art. It would be a further advancement to have such the elements of such detection systems communicate with each other using vital wireless communication protocols. It would be a further advancement to have the elements of such detection systems be power efficient, small size, modular, capable of rapid installation and easily reconfigurable. It would be a further advancement to have such detection systems combine magnetic field sensing, power efficient microprocessors, and wireless communications to detect train event data sequences and determine unique train identification signatures based upon the distortion of the local magnetic field by railcars moving within range of a sensor. It would be a further advancement in the art to identify individual trains, to recognize complex movement patterns and to verify identity, location and movement of individual trains over a variety of locations. Such advances will improve safety, and enhance the operation of train control signal systems and highway crossing signal devices.

SUMMARY

Embodiments of the present invention provide vital, effective and reliable railroad signal apparatus, methods, systems, techniques and the like through the collection, processing and evaluation of data. More specifically in some embodiments, magnetic sensor data generated by train movements within a detection zone is processed to isolate and identify a train event detection sequence (TEDS) and/or to identify a unique train identification signature (UTIS) (and/or UTIS data), which are used to verify train movement entering and exiting the detection zone (and in some cases within the detection zone). A train detection zone is established with magnetic sensor devices placed at the design-determined limits, access points and/or gateways of the zone. These sensor devices are configured to detect trains entering or leaving the zone. Sensor devices are fixed or mounted near a track of interest but do not rely on the track structure to detect trains.

Apparatus embodiments of a train detection system or the like can include (a) one or more anisotropic magnetoresistive (AMR) sensor elements; (b) microprocessor-based data collection, processing and evaluation; (c) data detection and evaluation that identify unique magnetic characteristics of a specific train configuration; (d) secure data spread spectrum radios; (e) independent power generation systems dedicated to sensor and communication power requirements; and (f) primary or secondary battery storage systems or capacitor based storage devices dedicated to sensor and communication power requirements.

In some embodiments sensor devices process one-dimensional or multi-dimensional, analog waveform data generated by sensor elements when a train moves within range of a sensor device (e.g., one or more AMR sensor elements). The analog waveform data is converted to a digital representation of the analog waveform which is evaluated by waveform feature extraction methods and/or processes to produce a Train Event Data Sequence (TEDS). The sensor device processor can evaluate the TEDS and any other related data to determine if a train stopped within sensor device sensing range and may apply dynamic time warping methods to extract a Unique Train Identification Signature (UTIS) and/or UTIS data. UTIS data is time-stamped and sent to a zone processor, which receives and compares such UTIS data (and possibly other data) transmitted by the sensor devices at or within the detection zone limits. The zone processor can apply peak detection, dynamic time warping and other matching methods to determine degree of match between UTIS data from various sensor devices at various times in the zone. If matching test results satisfy threshold criteria, the zone processor output state will indicate an unoccupied detection zone. If the match tests fail, the zone processor output state indicates an occupied detection zone. Unlike earlier systems and methods that only identified when a peak was detected, embodiments hereunder measure and map the amplitude or magnitude of magnetic flux peaks (either absolutely or relative to a baseline flux level) and utilize the digital representations of measured amplitude values and their sequence to assist in generating the UTIS data.

In some embodiments the sensor devices transmit time-stamped TEDS to the zone processor. The zone processor may evaluate the TEDS received from all detection zone sensor devices to determine if a train has stopped within sensing range of one or more of the sensor devices and may apply peak detection, UTIS matching, train stop detection, dynamic time warping and/or other methods to determine the UTIS assignment for each sensor device. Time stamps received with TEDS from each sensor device may be assigned to the UTIS results. The zone processor may apply dynamic time warping and/or other matching methods to determine degree of match between UTIS received from each sensor device within the detection zone. If matching tests results satisfy threshold criteria, the zone processor output state will correspond to an unoccupied detection zone. If the matching tests fail, the zone processor output state will correspond to an occupied detection zone.

BRIEF DESCRIPTION OF THE DRAWINGS

The present invention will be readily understood by the following detailed description in conjunction with the accompanying drawings, wherein like reference numerals designate like structural elements, and in which:

FIG. 9 is a flow diagram of a peak detection process that can be used to define a unique identification signature in one or more train detection embodiments according to one or more embodiments of the present invention.

FIG. 10 is a flow diagram of a unique identification signature matching process used to determine multiple instances of a unique identification signature in one or more train detection embodiments according to one or more embodiments of the present invention.

DETAILED DESCRIPTION

Figure 1:
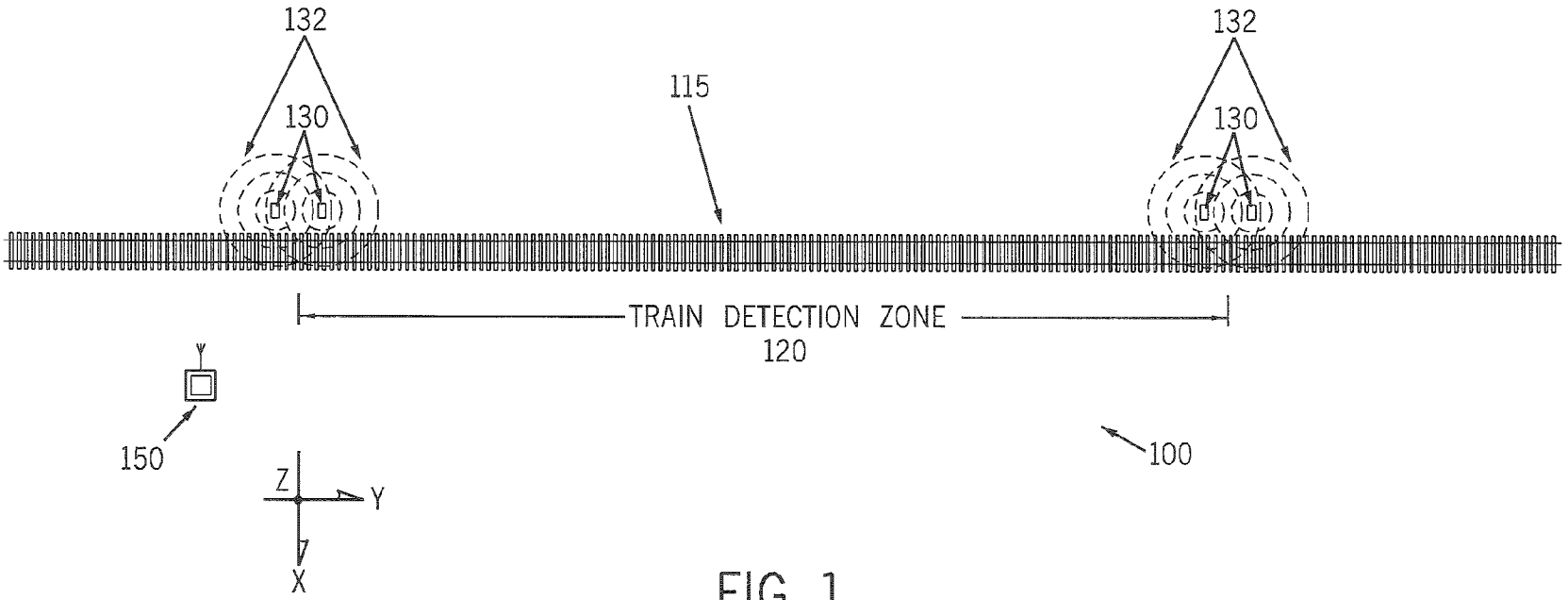
FIG. 1 is a plan view of one or more train detection embodiments according to one or more embodiments of the present invention.

The following detailed description will refer to one or more embodiments, but the present invention is not limited to such embodiments. Rather, the detailed description and any embodiment(s) presented are intended only to be illustrative. Those skilled in the art will readily appreciate that the detailed description given herein with respect to the Figures is provided for explanatory purposes as the invention extends beyond these limited embodiments.

Certain terms are used throughout the description and the claims to refer to particular system components. As one skilled in the art will appreciate, various companies, individuals, etc. may refer to components by different names. This disclosure does not intend to distinguish between components that differ insubstantially. Also, phrases such as "coupled to" and "connected to" and the like are used herein to describe a connection between two devices, elements and/or components and are intended to mean physically and/or electrically either coupled directly together, or coupled indirectly together, for example via one or more intervening elements or components or via a wireless connection, where appropriate. The term "system" refers broadly to a collection of two or more components and may be used to refer to an overall system (e.g., a computer system, a sensor system, a network of sensors and/or computers, etc.), a subsystem provided as part of a larger system (e.g., a subsystem within an individual computer and/or detection system, etc.), and/or a process or method pertaining to operation of such a system or subsystem.

In this specification and the appended claims, the singular forms "a," "an," and "the" include plurals unless the context clearly dictates otherwise. Unless defined otherwise, technical and scientific terms used herein have the same meanings that are not inconsistent to one of ordinary skill in the art relevant to the subject matter disclosed and discussed herein. References in the specification to "embodiments," "some embodiments," "one embodiment," "an embodiment," etc. mean that a particular feature, structure or characteristic described in connection with such embodiment(s) is included in at least one embodiment of the present invention. Thus, the appearances of the noted phrases appearing in various places throughout the specification are not necessarily all referring to the same embodiment. In the following detailed description, references are made to the accompanying drawings that form a part thereof, and are shown by way of illustrating specific embodiments in which the invention may be practiced. These embodiments are described in sufficient detail to enable those skilled in the art to practice the invention, and it is to be understood that other embodiments may be utilized and that structural, logical, electrical and/or other changes can be made without departing from the spirit and scope of the present invention.

Two methodologies for determining whether a specified length of train track is occupied by a train include a first methodology that involves continuously monitoring the entire length of a defined track-based detection zone, that is, monitoring whether a train occupies the track and, if so, where on the track section that train is located. Track-based train motion detection systems operate on this type of principle. As long as the detection process is not interrupted, it will reflect the occupancy status of the track section. The second methodology, utilized in embodiments of the present invention, uses event sampling and relies on continuously monitoring all entrance/exit points (also referred to as "access points" or "gateways") to the monitored space (i.e., the track section). It should be noted that these gateways are not necessarily physical structures through which trains or other vehicles pass (though they can be), but instead are points on a railroad track that define the detection zone to be monitored, controlled, etc. Trains (and possibly other objects) are detected and identified (e.g., using a digital representation or mapping of the train or other object's physical characteristics, such as a magnetic profile or signature (i.e., UTIS) such as a set, vector or matrix containing a specific sequence of measured absolute, differential or relative magnetic flux amplitude measurements) as they move past the entrance/exit points, access points or gateways, but the track section is not itself monitored. Because such systems do not maintain constant detection "contact" with trains in the detection zone being monitored, the detection system must be able to uniquely identify an entire train entering a detection zone to verify that the entire train has left the detection zone and that the zone is clear of the train. Again, objects are detected and identified only as they enter and exit the detection zone. Train detection embodiments using event sampling can use devices that act as event detectors, for example cameras, infrared sensors, photovoltaic sensors, pressure sensors, actuators, electrical field sensors, magnetic field sensors, proximity sensors, etc. including magnetic loop detectors, magnetic wheel counters, magnetometers, anisotropic magnetoresistive sensors, etc. In some train detection embodiments hereunder, specific attributes of a detected train entering the detection zone might change after zone entry; event sampling according to those embodiments will identify changes to the train and thus detect such changes (e.g., a rail car being left in the detection zone, the offloading of cargo, etc.)

Important in the implementation of a train detection system, method, etc. is the accurate and reliable determination for each detection zone event that (1) the detected "event" is a train, and then either (2a) that the entire train entered the detection zone and that the entire train exited the detection zone, or (2b) that only a portion of a train entered the detection zone and that the detected portion of the train that entered the zone also exited the zone. A system which defines a detection zone by placing sensors at intervals that guarantee that at least one sensor will be within sensing range of the smallest railcar or rail vehicle of interest that may occupy the detection zone minimizes data processing at the sensor level (if the sensor detects an event that satisfies threshold criteria, it reports "occupied" and if it does not detect a threshold event, it reports "unoccupied"). This process is a leading and trailing edge detection paradigm. Minimum sensor spacing and continuous monitoring is essential to the vitality of the system and, assuming a minimum railcar length of 30 ft and a sensor range of 20 ft, this method requires installation of at least 106 sensors per mile of detection zone (sensor redundancy would require a minimum of 212 sensors per mile). If sensors are not placed to satisfy the minimum distance, the vital operation of the detection zone is compromised.

Train detection embodiments disclosed and claimed herein place train detection sensor devices on or near a track of interest and define the detection zone by placing sensor devices at the zone limits or boundaries (i.e., gateways or access points). It should be noted that, while a typical detection zone might have two gateways at either end of a single track, other detection zone and gateway configurations can be serviced by train detection embodiments herein. For example, several separate tracks might cross the road or be in the same general location; each end of such tracks would thus represent a gateway. Moreover, in another exemplary configuration, a railroad track might have one or more spurs, meaning that a detection zone for this track could have 3, 4 or more gateways to monitor entering and exiting trains on the "main track" and any connected spurs. Sensor devices continuously process data to determine sensor device status and to detect and identify any event occurring within sensor device range. Train events occur within range of the sensor devices. To determine if a detection zone is occupied or unoccupied, sensor devices evaluate the train event as it occurs. Train event data is the data generated by each sensor device in response to detected physical characteristics of the train and any modification due to the particular actions of the train as they occur within range of the sensor device. Train event data is processed and evaluated to separate data relating to unique physical characteristics of the train (e.g., the train's magnetic profile) from data representing the train's movement(s). The result of such processing may be referred to as a unique train identification signature (UTIS), which in some embodiments can be or include a digital representation or mapping of the train's magnetic profile or signature (i.e., UTIS) comprising a set, vector, matrix or the like containing a specific sequence of (absolute, differential or relative) magnetic flux amplitude values. The same processing technique is applied at all sensor devices defining the detection zone. The UTIS generated by each sensor device for each detected train is compared by a zone processor to monitor movements of trains within range of the detection zone's sensor devices. If the UTIS of a train that has exited the detection zone matches the UTIS of a train that previously entered the detection zone, the zone cannot be occupied by that identified train. If such UTISs do not match, the zone must be occupied (i.e., the train detected as having entered the detection zone has not yet exited). The challenge for this detection scheme is to produce a reliable UTIS, which is especially difficult when train event data includes complex train movement data that may be generated by a train moving in one direction, stopping, moving in the opposite direction, stopping, etc. within sensor device range. In spite of these and other significant detection and data processing challenges, the advantages of this approach include the ability to define train detection zones of any length with two sensor devices. Detection zone "vitality" (as defined herein) resides in the processing of train event data, independent of sensor device placement. Design redundancy is easily achieved by pairing sensor devices at each detection zone gateway.

Train detection embodiments herein (1) do not rely on track rails to define the detection zone; (2) are immune to ballast or rail condition; (3) are not affected by operation of track-based circuits or track-based detection zones; and (4) do not have any effect on the operation of track circuits or track-based detection zones. Moreover, some train detection embodiments can be installed in conjunction with track-based signal circuits, elements and devices to augment or enhance their operation. Also, some train detection embodiments are alternative vital train detection devices and systems.

Train detection embodiments herein include apparatus, methods, systems, techniques, etc. for vital train detection and other functions utilizing electromagnetic-based techniques making such vital technology feasible for government agencies and railroads to install with railroad signal systems, including wayside signal systems and highway crossing signal systems to reduce the likelihood of accidents, deaths, injuries and property loss. Some embodiments utilize power efficient microprocessor-based technology and components, including various anisotropic magnetoresistive (AMR) sensor elements, spread spectrum data radio communication devices and local power generation and storage devices. AMR sensor devices are suitable for continuous monitoring of the Earth's magnetic field within sensor range and enable collection of data for waveform data processing that can be the basis of a vital apparatus, method, system, technique, etc. The term "data" and the term "information" may be used interchangeably in this disclosure and any claims, unless clearly indicated to be distinct.

Each car of a train and, in many instances, each car's cargo generates a magnetic field, or stated another way, they each present a magnetic profile. There is considerable variation in the detected magnetic flux density of a given rail car and there are substantial differences between rail cars and locomotive power units, between operating and idling locomotive power units, and between rail cars themselves. A coupled train exhibits a consistent flux density pattern over time if the composition of the train and its cargo is not changed. If relevant changes are made to a train (e.g., rail cars are added or removed from the train, ferromagnetic cargo is loaded or unloaded from a rail car, the order and orientation of rail cars within the train are changed), the magnetic flux density of the train is changed and this change is detectable by the sensor devices and methods described herein. Moreover, while the magnetic profile of a given train (i.e., its UTIS) is static (so long as no changes are made to the train), the train event data collected for a given train can vary depending upon the train's direction of movement, speed, etc., even though its UTIS remains constant.

An AMR sensor can readily detect a train's presence within the sensor's range and AMR sensors are used throughout much of this disclosure to describe train detection embodiments. However, as will be appreciated by those skilled in the art, other discrete sensor devices can be used in some train detection embodiments herein and so the use of AMR sensors generally, and specific AMR sensor types in particular, are only illustrative and are not in themselves the sole type of sensor element, sensor and/or sensor device that can be used in train detection embodiments herein.

While a train is within the detection range of a given AMR element sensor device, the AMR elements of the sensor device generate time series analog waveform data of a train event. A "train event" in some embodiments comprises all of the waveform data collected by a sensor device during the time that a given train is moving in any direction or is stopped within range of the sensor device. This analog waveform data can be spatially one, two or three-dimensional (because analog waveform data is collected over a period of time, a temporal dimension is also inherent in such collected analog waveform data). As will be appreciated by those skilled in the art, multiple spatial dimensions of waveform data permit more precise identification of train features and better resolution of the unique magnetic characteristics or profiles of individual trains and the like, though one-dimensional waveform data may be sufficient for some embodiments. The sensor device encodes the analog waveform data through a digital conversion and detection process to generate a unique train identification signature (UTIS) for a given train event. As noted above, the UTIS for a given train can be a digital representation or mapping of the train's magnetic profile or signature in the form of a set, vector, matrix or the like containing a specific sequence of (absolute, differential or relative) magnetic flux amplitude values. These amplitude values and their specific sequence provide a unique signature for each train entering and exiting a detection zone.

Each sensor element can be one of the following sensors made by Honeywell International Inc. of Morristown, N.J.—HMC1001, HMC1002, HMC1021, HMC1022—or can be one of the following sensors made by NVE Corporation of Eden Prairie, Minn.—AA002-02, AA003-02, AA004-00, AA004-02, AA005-02, AA006-00, AAH002-00, AAH004-00, AAL002-02. The amplifier/ADC unit can be part of the sensor device processor, for example a Texas Instruments MSP430F427 ultra-low-power microcontroller or the like. The power supply can include a Texas Instruments BQ24071 single chip Li-Ion charge and system power path management IC. The processor in each sensor device can regulate power via a constant current or other energy/power source (e.g., a National Semiconductor LMC7101 CMOS operational amplifier or the like) used to operate each sensor element. The sensor element set/reset component (e.g., a combination of an International Rectifier IRF7105 HEXFET power MOSFET and Maxim MAX662 low-profile flash memory supply) coupled to and controlled by the sensor device processor can provide gain/offset compensation, feedback and/or compensation circuits to maintain optimum detection condition of each sensor element. Each radio can be a unit comprising a Digi International XBP09-DMWIT and a TI CC2530, providing system-on-chip functionality for 2.4 GHz IEEE 802.15.4/RF4CE/ZigBee operation. Non-volatile memory can be implemented using an Atmel 16 megabit AT45DB161D flash memory or the like to store sensor device parameters, configuration data, temporary data, etc. The sensor device dedicated power generator energy supply may include solar, piezo, magnetic induction, thermo, wind, pressure, and/or vibration generator devices, primary and/or secondary battery elements, ultra-capacitor energy storage, and like elements in various combinations.

In one embodiment, a given train detection event begins with a train's entry into a detection zone and ends when all cars that constituted the original entering train are confirmed to again be outside the detection zone. Determination of entrance and exit for a train event depends upon evaluation of the waveform data at the sensor device. Necessary criteria include verification that one or more waveform baselines correspond to an "unoccupied" value followed by baseline offset(s) over time that satisfy criteria corresponding to magnetic flux variations consistent with a moving train. If the train continues moving within range of the sensor device, the amplitude and rate of change of the sensor element bridge voltage will track the time-based distortion of the local magnetic environment within range of the sensor elements. The compression of the waveform elements is proportional to the speed of the train. If the train stops moving within range of the sensor device, the unchanging distortion of the local magnetic environment will cause a corresponding shift in the reference baseline from its unoccupied value. If the train should reverse its direction, the amplitude variations of the resulting waveform will be the mirror image of the train's movement in the original direction. Waveform compression will be a function of train speed. If the train continues in reverse direction beyond the range of the sensor device first encountered by the train as it entered the detection zone, exit criteria has been satisfied. When the train moves beyond sensor device range the waveform returns to the baseline reference and the train event has ended. All sensor devices respond to a train within their sensing range as described above. The actual waveform data processed at each sensor device assigned to the detection zone will be different, depending upon the location of the sensor device within the zone and proportional length of the train entering the sensor device's range. The UTIS generated by each sensor will be the sum of the forward and reverse movements (zero for equal forward and reverse movements).

Each sensor device transmits operational status and UTIS data to the zone processor. The zone processor evaluates and compares UTIS data received from all of the detection zone sensor devices to determine status of the detection zone. If the zone processor receives a UTIS of zero from one or more sensor devices defining a detection zone and if the sequence and time stamps satisfy the application logic for the zone, the zone processor output state will correspond to an unoccupied zone. One skilled in the art will readily see the multiple layers of redundancy designed into this system and method. Each sensor device tracks directional changes within its sensing range and the zone processor requires that all devices agree if the zone is to be declared unoccupied. In the event of a train entering a detection zone and continuing in the original direction to exit the zone, each sensor device will transmit a time-stamped UTIS data to the zone processor. The zone processor will evaluate and compare UTIS data received. If time stamps satisfy logical criteria, the UTIS data are equivalent, and the sensor devices are reporting no detection, the zone processor output will correspond to an unoccupied zone. If any of these conditions are not met, the zone processor output will correspond to an occupied zone.

Sensor device placement enhances the reliability of train detection for embodiments that rely on peak detection and mapping (i.e., the generation of a vector or matrix containing digital data representing peak amplitude values in their proper sequence). For example, improved results can be obtained when sensor devices are placed at the same vertical elevation relative to the top of the rails and the same lateral spacing from the reference rail. Peak detection and mapping also requires that the sensor device must include circuitry to provide a constant current to the sensor elements. In general, single axis waveform processing is sufficient for reliable train detection. In the event that a sensor device is placed where the environmental magnetic characteristics differ significantly from those of the other sensors, multiple-axis waveform processing may be necessary to assure reliable operation. Also, susceptibility to magnetic domain disruption can be reduced by proper sensor placement. Sensor devices placed at or near the grade surface within five feet of a track rail are at risk of saturation. This saturation risk is significantly reduced if sensor devices are placed two feet below grade surface and covered with material that has a magnetic permeability $\mu$ less than one. Saturation risk is also substantially reduced for sensor devices placed fifteen feet from the nearest rail and at grade surface.

Defined detection zones can be discontinuous and fully discrete from any other zone. Depending upon the operational parameters for a multiple track layout, sensor device data may be either shared or not shared by the application logic of the zone processor. Typical applications for two or more adjacent tracks within a particular area of interest would not share sensor data between logical operations unique to each track. Although the zone processor would evaluate sensor device data for each track independently of data received from other tracks, the zone processor output may be a composite of the application outcomes for each of the separate tracks. An example is a highway-railroad grade crossing equipped with crossing signals controlled by the output of the zone processor. If the logical process for any of the multiple tracks satisfies the criteria for a train approaching the crossing, the zone processor would assume the output state that activates the crossing signals. If the output of the logical process satisfies the criteria for all detection zones not occupied or, if occupied, the train is moving away from the crossing, the zone processor would assume the output state that deactivates the crossing signals.

In some applications, sensor device data from discrete detection zones may be analyzed by the zone processor to determine three-dimensional characteristics of a particular detection zone within the detection sensor device array. The potential power of this approach will be readily apparent to one skilled in the art. Each sensor device may be configured with three-dimensional sensor elements and zone processor analysis of discrete detection zones created by properly placed sensor devices enables a three-dimensional evaluation of the train events occurring at the detection zones' limits based upon three-dimensional data from each of the individual sensor devices deployed to define the zones. This approach enables accurate detection and differentiation of multiple trains moving (or stopped) on multiple tracks within an area of interest. The zone processor in some embodiments FIG. 5 may include a vital processing module, a communications module, an I/O module and a software user interface that operates in accordance with both fail-safe operational principles, as described above, and the closed circuit principle, also described above. The vital processing module contains two independent but identical processors with their respective peripheral chipsets. A third processor serves as an arbitrator and interface to the other modules of the zone processor.

Figure 5:
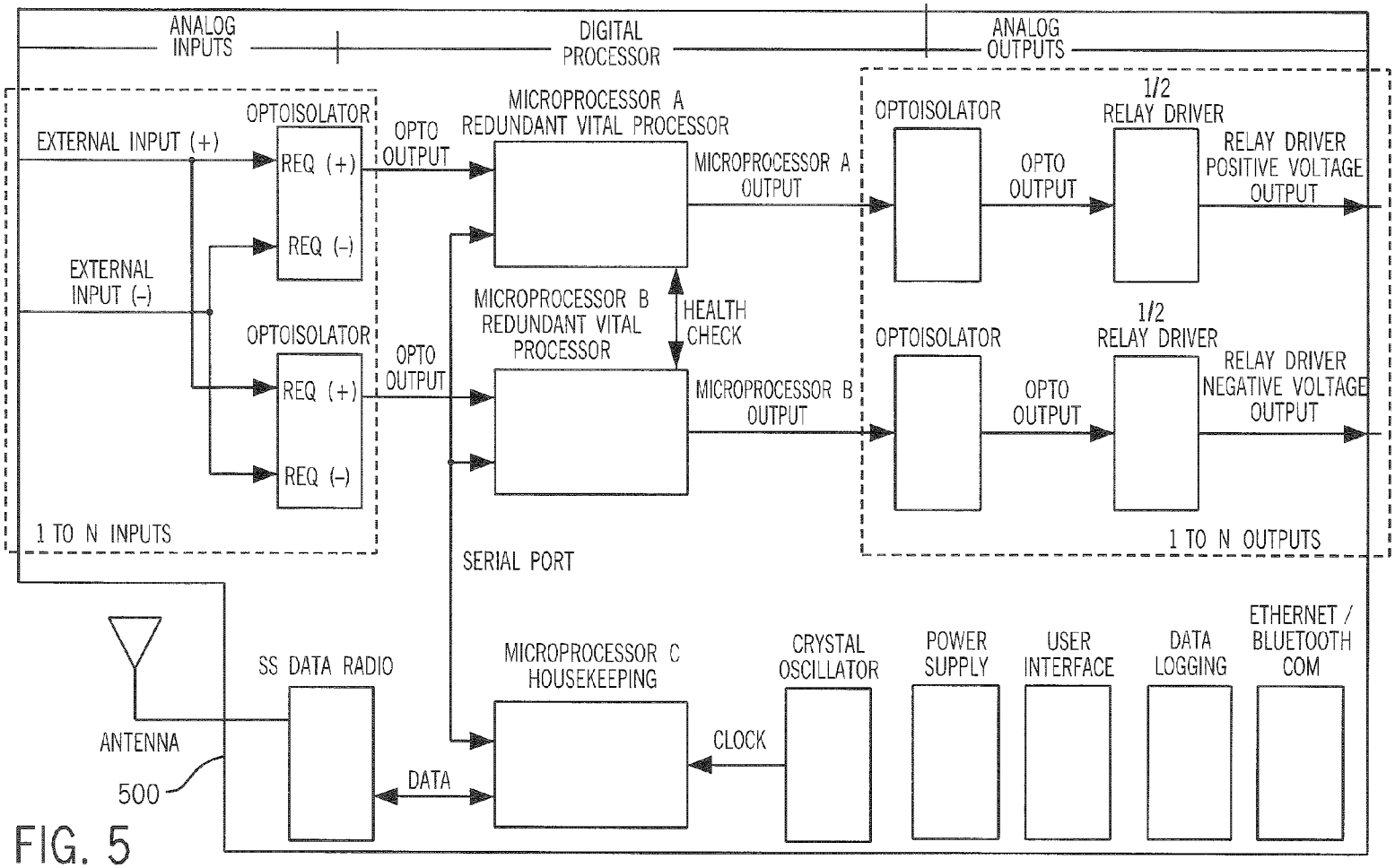
FIG. 5 is a block diagram of one or more vital processing device embodiments usable in connection with one or more embodiments of the present invention.

The zone processor of some embodiments described herein can include a vital processing device such as the device 500 shown in FIG. 5. Such a device can include embodiments disclosed in United States Publication No. 2008/0183306 A1, published 31 Jul. 2008, the entire disclosure of which is incorporated by reference in its entirety for all purposes. In other embodiments, the zone processor can be distributed apparatus that performs the functions described herein for the zone processor. For example, in some cases the sensor devices might serve as cooperative parts of a zone processor, performing processing functions and vitality checking (e.g., verifying the operational status of each other as sensor devices in a vital system) in a distributed manner. Also, a "master" sensor device might be designated, equipped and/or programmed to perform in a dual role as both a sensor device and the zone processor. For purposes of illustration, a separate zone processing apparatus is depicted and described in connection with a number of train detection embodiments herein, but is not limiting.

Communications protocols, whether via direct wiring between sensor devices and the zone processor or via wireless devices must satisfy communication self checks that verify the operational status of the communications system itself. One embodiment requires that each sensor device send its time-stamped operational status to the zone processor at least once every second. The zone processor must receive and properly evaluate received data from all sensor devices to determine reliably whether the detection zone is unoccupied. The output of the zone processor will correspond to an occupied detection zone if at least one of the following exemplary conditions exists:

- if detection data received from the sensor devices satisfies zone processor criteria that a train has entered and is occupying the zone;
- if the operational status of any of the sensor devices cannot be verified;
- if an expected communication from a sensor device data is not received by the zone processor within an allotted time;
- if the zone processor fails its own operational self-check.

Wireless communication between the sensors and zone processor in some embodiments can be a spread spectrum link, secure and encrypted so that it cannot be replicated, decoded or decrypted.

In embodiments where vital detection and monitoring of the detection zone is desired or required, communications must maintain vitality. For example, communications between any sensor devices and zone processor must meet minimum vitality requirements by implementing a vital communications protocol that will verify the integrity and operational status of the elements of the communication means. Verification must be sufficient to ensure that, in the event of a communications failure, the communicating devices will not violate the fail-safe principle.

Power sources can include one or more of the following: a primary battery, a wind-driven generator, a solar power system, piezoelectric energy harvesting device, vibration energy harvesting device, a thermogenerator device, a pressure difference generator device, combined with a secondary battery, ultra-capacitor storage device, or other self-sustaining, self-charging power technique/source. Power sources may be dedicated to each sensor device, to a group of sensor devices, to the power/radio node, to the zone processor and/or to any intermediate devices necessary to sustain reliable operation of the detection system. Where available and desired, power may be supplied to any of these elements from devices that are connected to commercial power sources. Fuel cell systems may be a suitable energy source to power the zone processor.

In one train detection embodiment shown in FIG. 1, a pair of AMR wireless sensor devices 130 is placed at each end of the desired detection zone 120 for the track of interest 115. These four sensor devices 130 maintain a communications protocol with a zone processor 150. The sensor devices' AMR sensor elements continuously monitor the local magnetic field that is within sensor range 132. Each sensor device 130 processes this AMR data to determine the status of the local magnetic field. Each sensor device 130 is communicatively coupled to the zone processor 150 (e.g., via direct cable connection, direct wireline or spread spectrum data radio system) and thus transmits time-stamped status information to zone processor 150. Should any sensor device 130 fail to transmit status data (e.g., indicating to processor 150 that the sensor device 130 is properly operating and monitoring its detection range) to the zone processor 150 within the communications protocol parameters, zone processor 150 will revert to its safest condition and its output state will be consistent with an occupied detection zone. Each sensor device 130 converts the output from its AMR sensor element(s) to digital data. In the event that an AMR sensor element detects a change or disturbance of the local magnetic field, the output change over time is processed or generated as an analog waveform that is converted by the sensor device's processing components to digital data. Each sensor device 130 evaluates this digital data and transmits it with a time stamp to the zone processor 150. Data produced by the waveform detection process of sensor device 130 is evaluated at the sensor device to determine if it satisfies train detection criteria. The sensor device may perform additional data processing to evaluate a train event data sequence (TEDS) and to determine and generate a unique train identification signature (UTIS), for example, as a vector or matrix of digital data comprising a specific sequence of amplitude values or the like; or digital sensor data may be time-stamped and transmitted to the zone processor 150 for further processing.

The zone processor 150 evaluates data received from each sensor device 130 fixed or mounted adjacent to a railroad track segment in detection zone 120 to:

- identify train events;
- evaluate detection sequence within detection zone 120 sensor device array;
- evaluate the waveform data of each sensor device 130 to determine the current status of detection zone 120.

If data received from sensor devices 130 satisfies the zone processor's 150 train detection criteria for recognizing a train entering the detection zone 120, the zone processor output state (e.g., output signals sent to signaling devices, etc.) will be consistent with an occupied detection zone. Zone processor evaluation of waveform data from each sensor device 130 detects unique data characteristics that identify a specific train and also detect the train event data caused by a train stopping and resuming original movement in same direction or reversing the direction of movement within sensing range 132 of a sensor device 130 fixed or mounted adjacent to a track segment in the detection zone. In some embodiments, this process is accomplished by the sensor device processor. Waveform data collected and transmitted by each sensor device 130 within the detection zone 120 must be evaluated to detect the unique data characteristics that identify the train. The zone processor 150 evaluates this train identification data with appropriate data processing techniques to determine the degree of match between various data received from each sensor device 130, for example to compare and/or attempt to match two or more instances of a digital data vector or matrix provided by a sensor device 130 as a UTIS, comprising a specific sequence of digital magnetic flux amplitude values or the like. If the evaluated match satisfies defined criteria for a train exiting detection zone 120, zone processor's 150 output state will indicate that detection zone 120 is clear of the train and unoccupied. One skilled in the art will appreciate that a match can occur only if the waveforms (and/or data characteristics derived from waveform data) are essentially identical. In some embodiments, the only conditions that produce identical waveforms occur when:

- the entire train completely exits the detection zone 120; or
- the entire train enters the zone, moving beyond sensing range of any sensor device, stops and reverses direction to exit the zone; or
- or a portion of the train enters the zone, stops within sensing range of a sensor device and reverses direction to exit the zone.

Waveform data evaluation by the zone processor 150 can produce a variety of information relating to a train event, including direction of travel, train speed, and complex movement history. Sensor devices 130 are paired to assure independent and redundant data collection and evaluation that satisfy closed circuit and fail-safe principles. All sensor device pairs and both sensor devices of a pair must transmit waveform data to the zone processor and adhere to the communications protocol or the zone processor's 150 output status will be consistent with an occupied track zone. The design and data processing scheme of zone processor 150 must satisfy railroad signal vital requirements for microprocessor-based devices to assure that the independent and redundant data sensor device data is processed independently and redundantly and that the independent results of the redundant processing agree. If any hardware or data processing component of the detection devices/zone processor system fails to perform its intended function, the zone processor 150 output must be consistent with an occupied detection zone (the zone processor's 150 most restrictive condition). All hardware elements and data processing results of the system must satisfy operational and identity criteria for the zone processor 150 output to be other than most restrictive condition. It will be appreciated by one skilled in the art that a train detection system that satisfies these criteria meets the definition of a vital system.

Figure 2A:
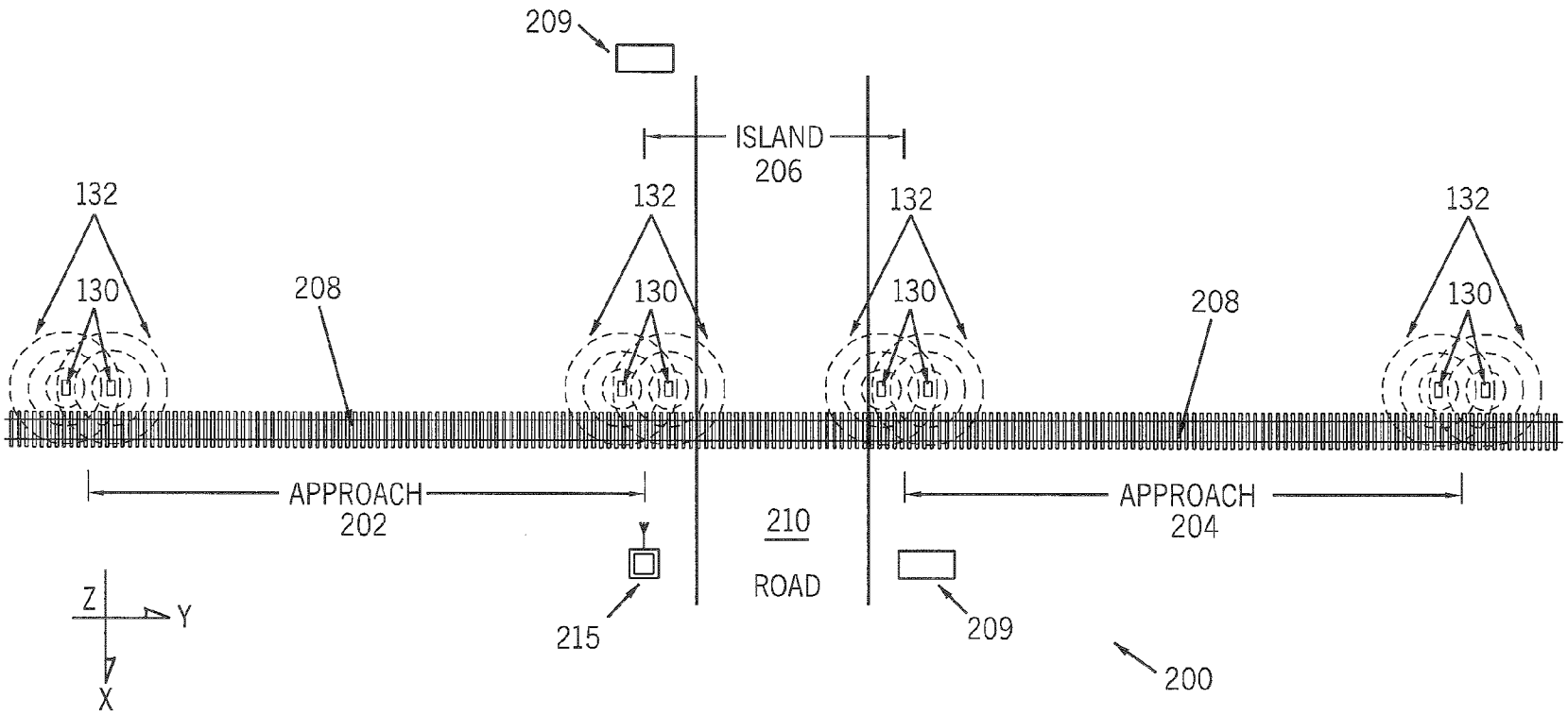
FIG. 2A is a plan view of railroad tracks intersecting a roadway at grade and one or more train detection embodiments according to one or more embodiments of the present invention.
Figure 2B:
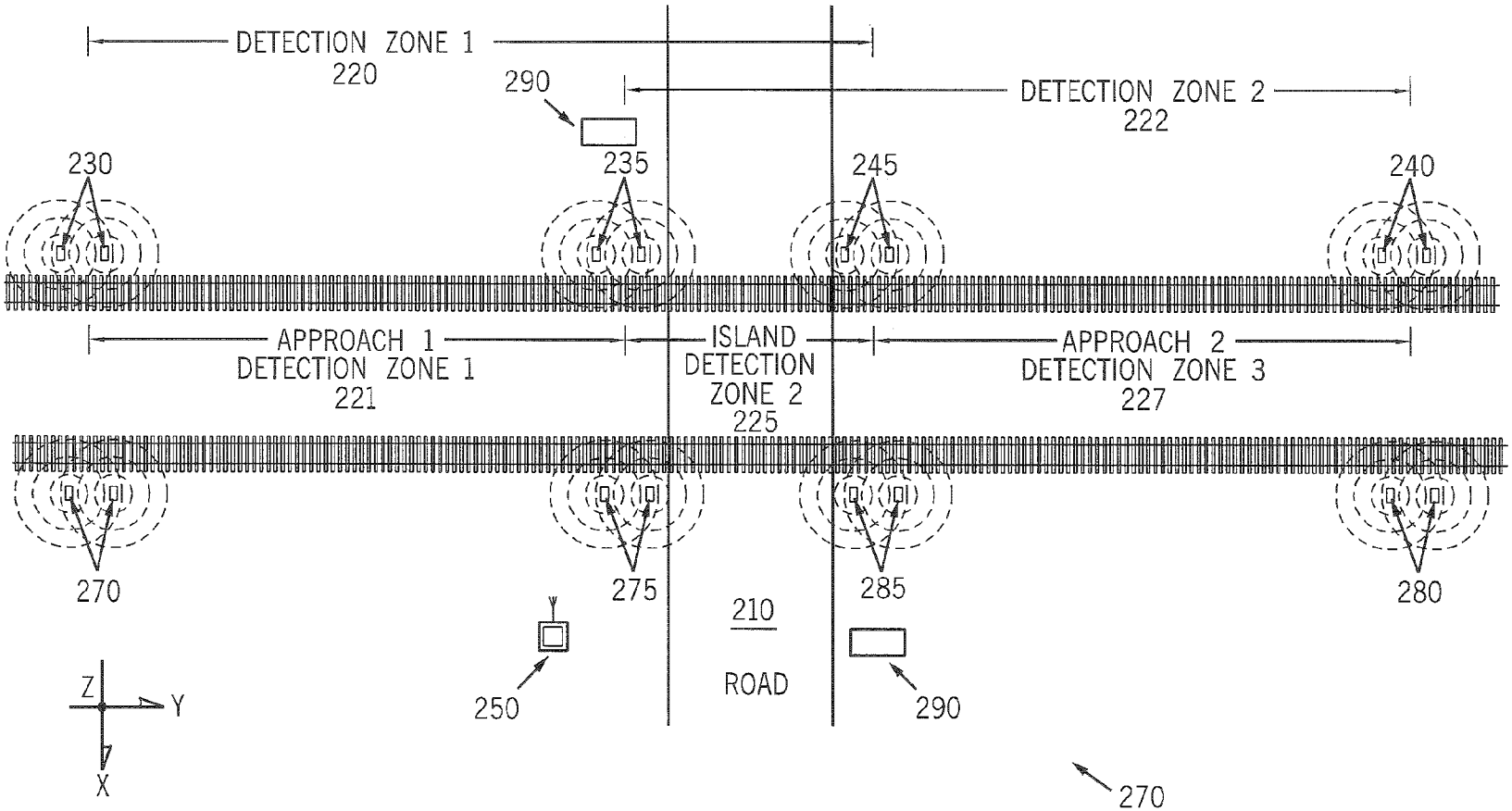
FIG. 2B is a plan view of a pair of railroad tracks intersecting a roadway at grade and one or more train detection embodiments according to one or more embodiments of the present invention.

One or more embodiments of a vital railroad train detection zone 200 are represented in FIG. 2A, illustrating an exemplary railroad crossing signal control system. As noted above, other train detection embodiments are used for monitoring, controlling, warning, providing information, etc. of trains and other rail-based vehicles in a variety of settings and for a variety of purposes. Train detection embodiments such as shown in FIGS. 2A and 2B can be installed independently of any other signal systems or devices to control crossing signals. The sensor device array can emulate any track-based train detection circuit or system. In FIG. 2A, train detection system 200 includes four pairs of sensor devices 130 (having sensor device sensing ranges 132) situated adjacent to railroad track 208 to define a train detection zone having a first approach detection sub-zone 202, a second approach detection sub-zone 204, and a central island detection sub-zone 206 to control one or more signal devices 209 at road 210. The signaling devices of system 200 are controlled by a zone processor 215. Data is collected, processed and transmitted to zone processor 215 by each sensor device 130, for example according to one or more embodiments described above.

FIG. 2B shows an exemplary system 270 emulating a typical DC track circuit configuration for two adjacent tracks in which eight sensor devices 230, 235, 240, 245, 270, 275, 280, 285 define contiguous detection zones 221, 225, 227 near each track for the purpose of controlling the operation of highway crossing signals 290. Sensor device pairs 230, 240, 270, 280 establish the distant limits of approach detection zones 221, 227 that activate the crossing signals 290 when a train approaches crossing 210. Placement of sensor device pairs 230, 240, 270, 280 is a function of maximum train speed allowed on the track of interest and the desired warning time activation period of crossing signals 290 when a train is approaching the crossing. Sensor device pairs 235, 245, 275, 285 on each side of road 210 define the island detection zone 225 for the two tracks. Sensor device pairs 235, 275 establish the limits of "Approach 1" detection zone 221 that are nearest the road 210. Sensor device pairs 245, 285 establish the limits of "Approach 2" detection zone 227 that are nearest the road 210. A track-based DC track circuit train detection strategy must provide three separate track circuits to supply the necessary logic to control crossing signals due to inherent limitations of track-based DC circuits. The criteria that must be satisfied require that the crossing signals will operate if a train has entered either approach (detection zone 221 or 222) to the crossing, that the crossing signals must operate whenever any portion of the train occupies the island (detection zone 225) which encompasses road 210 and that the crossing signals stop operating as soon as the train has left the island (detection zone 225) and is moving away from the crossing. Train detection embodiments shown in FIG. 2B may directly emulate the three discrete and contiguous track-based DC circuit configuration with three contiguously defined detection zones 221, 225, 227, or may achieve functionally identical control of crossing signals 290 by defining two partially overlapping detection zones 220, 222 that also overlap road 210. Physical placement of sensor devices 230, 235, 240, 245, 270, 275, 280, 285 is the same in either case. Application logic is implemented at the zone processor 250. The operation of crossing signals 290 will be identical regardless of whether three zone or two zone train detection logic is applied.

Figure 3A:
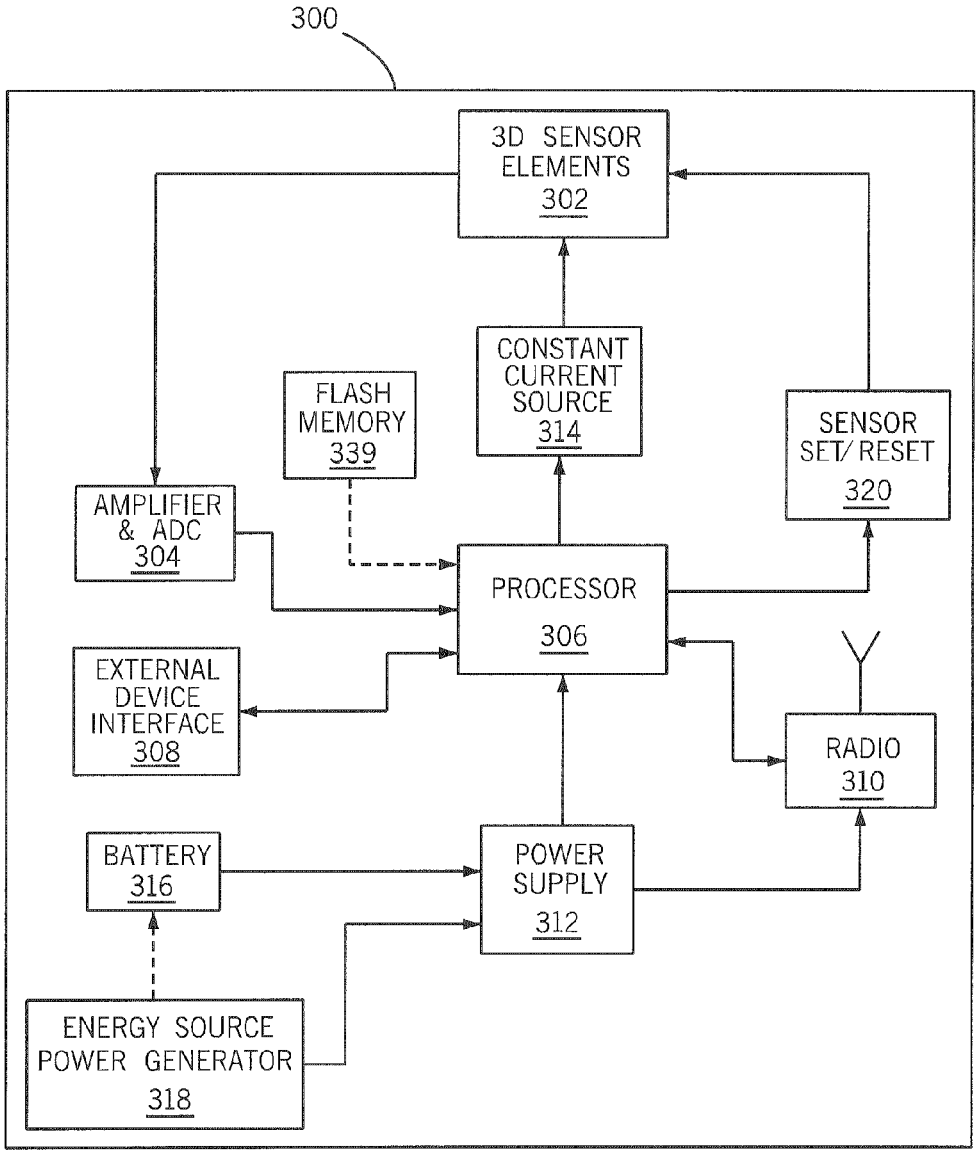
FIGS. 3A and 3B are block diagrams of sensor device embodiments according to one or more embodiments of the present invention.
Figure 3B:
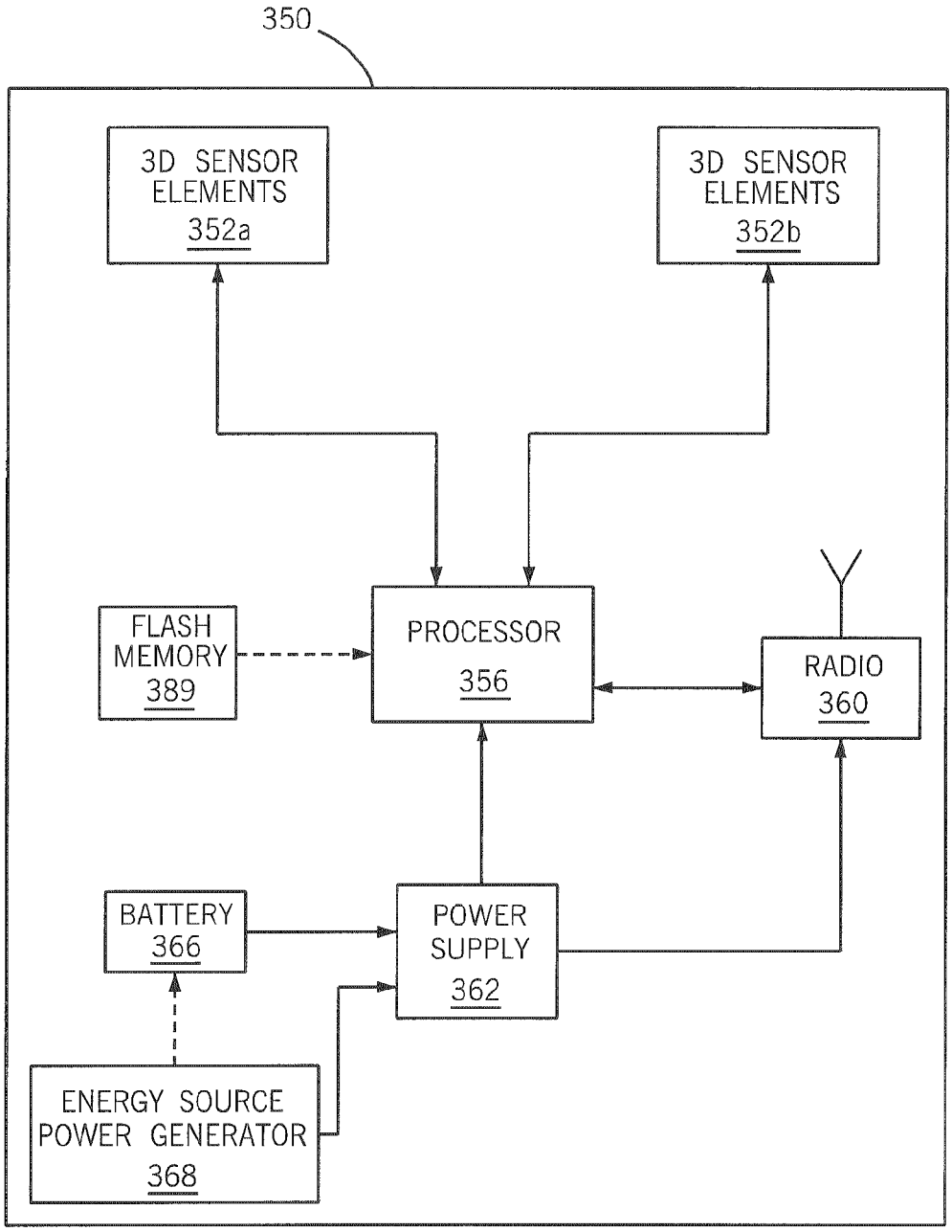

Sensor devices of various train detection embodiments generate data configured as a waveform representing the effects of predominant ferromagnetic features of train cars on the Earth's magnetic field, which at any particular location is measurably affected by the presence of ferrous material altering the path of otherwise generally parallel magnetic field lines. Compression and expansion of magnetic flux lines affect one or more AMR sensor elements of sensor devices 130. Exemplary embodiments of sensor device configurations 300 and 350 are shown in FIGS. 3A and 3B, respectively. Referring to FIG. 3A a sensor element 302 can be an AMR sensor element providing one-dimensional, two-dimensional or three-dimensional analog waveform data as output data. Sensor element 302 is coupled to an amplifier and ADC converter 304 that outputs digitized waveform data to a processor 306 which can process, package and/or send data, information, and/or signals to a device external to sensor device 300 such as one or more zone processors, another sensor device, or other suitable devices using radio 310 or direct wire connection 308. Processor 306 can use supplemental memory 339 as needed and can be combined with the amp/ADC 304 as a general processor apparatus. Sensor device 300 has a power supply 312 that provides power to processor 306 and radio 310 in some embodiments. Processor 306 can provide power to sensor element 302 through a constant current source 314. Power supply 312 is energized by an appropriate local power source (e.g., a battery 316, ultra-capacitor, and/or a power generator 318 dedicated to sensor device 300). In some embodiments sensor element 302 can be set and reset and/or otherwise adjusted for bias, etc. by a sensor element reset control unit 320.

In FIG. 3B, multiple sensor elements 352*a*, 352*b*, etc. are coupled to processor 356. A radio 360 allows processor 356 to communicate with a variety of devices. Processor 356 and radio 360 receive energy from a power supply 362 that is energized by an appropriate local power source that can include a battery 366, ultra-capacitor, and/or a power generator 368 dedicated to sensor device 350. The configuration of FIG. 3B allows the collection of waveform data by multiple sensor elements without requiring a processor, radio, etc. for each sensor element. This configuration increases the size of the sensor device to provide necessary distance between sensor elements. Typical spacing between sensor elements may be one foot. For small sensor element separations, processor speed and capacity become critical design factors as maximum train speed increases. Such embodiments provide accurate speed calculations.

The zone processor of embodiments described herein can include a vital processing device such as the device 500 shown in FIG. 5. Such a device can include embodiments disclosed in United States Publication No. 2008/0183306 A1, published 31 Jul. 2008, the entire disclosure of which is incorporated by reference herein in its entirety for all purposes.

Figure 4:
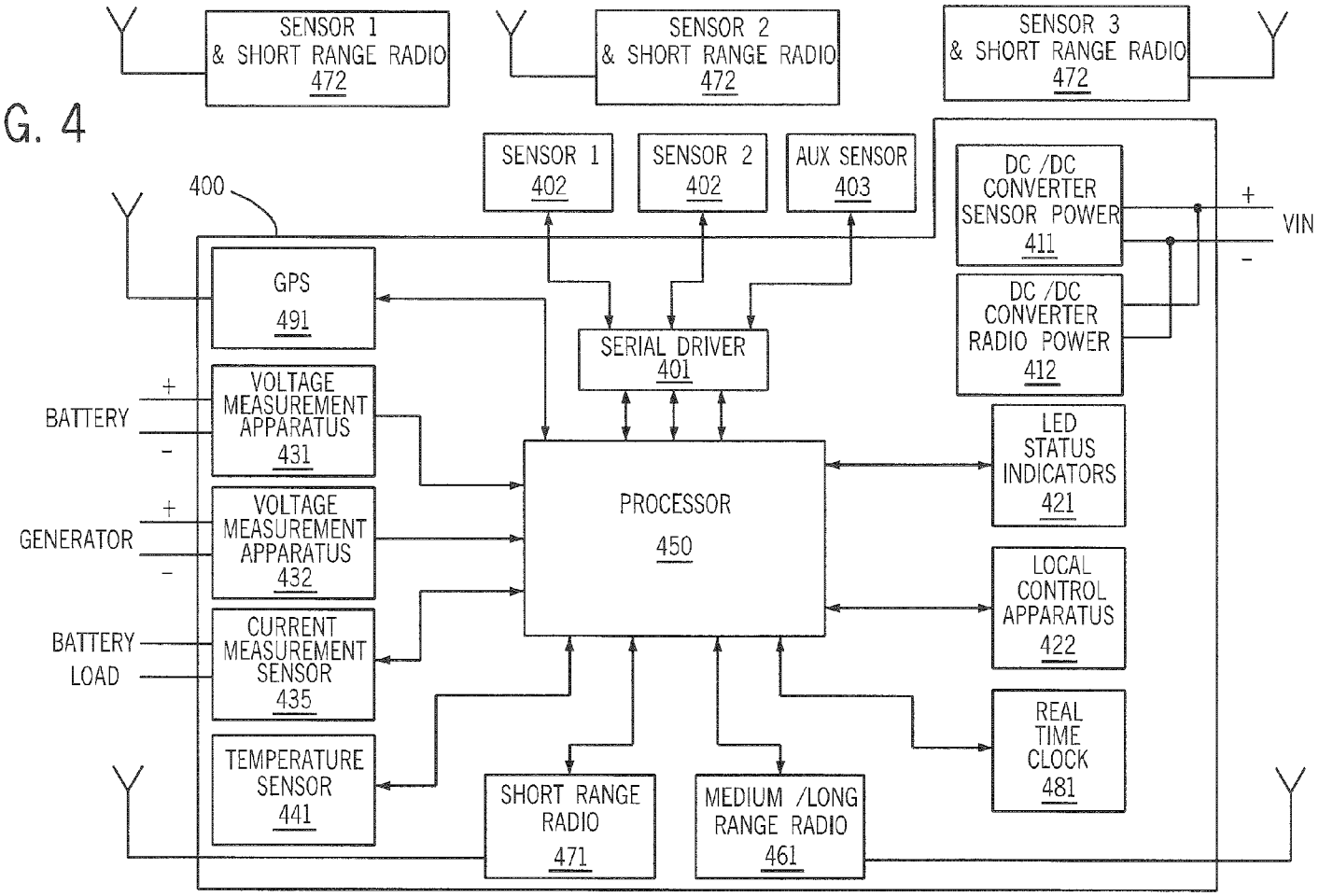
FIG. 4 is a block diagram of one or more power/radio node and radio module embodiments according to one or more embodiments of the present invention.

Referring to FIG. 4, some embodiments include radio/power nodes 400 to provide power to multiple sensor devices 402, 403, 472. Radio/power nodes can be equipped with medium to long range spread spectrum radios 461 and directional antennas to ensure efficient and reliable communication with zone processors. Radio/power nodes 400 provide a wireless gateway for communication between sensor devices and zone processor. Some embodiments of a radio/power node 400, as shown in FIG. 4, include a processor 450 (e.g. AtMega1280), a GPS module 491, DC-DC converters 411, 412, LED status indicators 421, local control and configuration buttons/switches 422, a real time clock 481, temperature sensor 441, voltage measurement apparatus 431, 432, current measurement sensor 435, serial port driver 401, medium to long range spread spectrum radio module 461 (e.g.XT09-SI) and short range spread spectrum radio module 471 (e.g. XBP09-DMxxx, CC2530, CC2540). The short range radio 471 enables wireless communication with sensor devices 472 installed near the radio/power node 400. The medium to long range radio 461 enables communication between the sensor devices and the radio/power node 400 with the zone processor. The GPS 491 provides accurate location data for the node and provides an accurate one pulse per second (PPS) time reference. The voltage and current measurement apparatus 431, 432, 435 monitors battery status and dedicated power generator status. This information is transmitted to the zone processor for performance logging and maintenance records. The real time clock 481 provides accurate time for synchronizing sensor devices and time-stamping data transmissions. The DC-DC converters 411, 412 provide isolated and regulated power to the radio/power node, the radios and the sensor devices. The serial drive 401 provides direct cable connection between the radio/power node module, sensor devices 401, 402 and other external devices 403.

Figure 6:
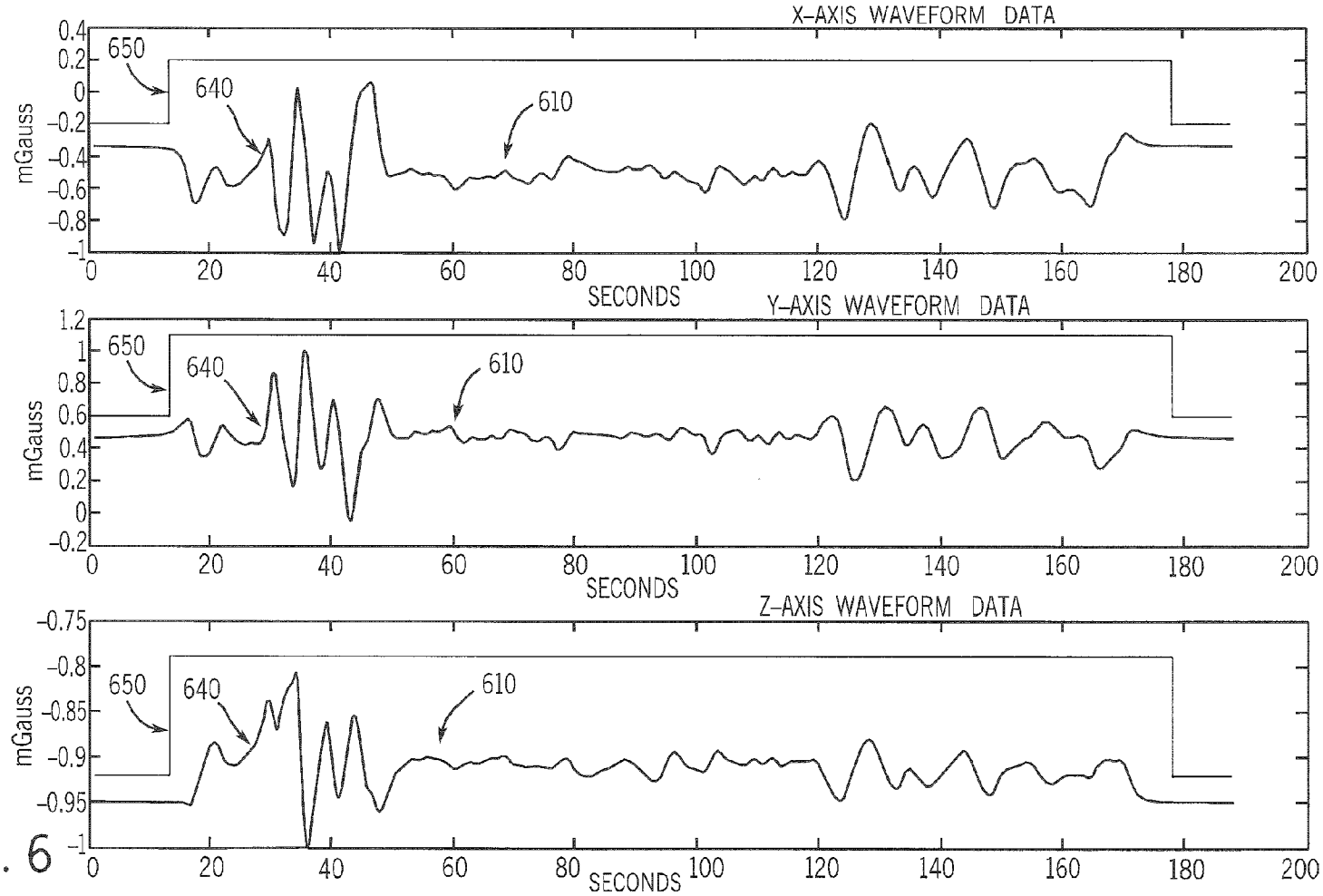
FIG. 6 illustrates three data plots showing data collected from a three-dimensional sensor element or the like measuring magnetic flux density in a detection zone through which a train is passing in one or more train detection embodiments according to one or more embodiments of the present invention.

FIG. 6 shows three plots of magnetic flux density generated by AMR sensor elements oriented in three spatial dimensions of a sensor device placed near a railroad track. The sensor element spatial dimensional references are designated the X axis (parallel to ground plane and perpendicular to track rails), Y axis (parallel to ground plane and parallel to track rails), and Z axis (perpendicular to ground plane). The horizontal axis of each plot is labeled according to its assigned spatial dimension. This axis is designated in elapsed seconds. The vertical axis of each waveform plot is designated in mGauss. Total elapsed time of the depicted train event is approximately 160 seconds. The generated three-dimensional analog data also can be expressed as digitized value vectors representing analog waveform data generated by the AMR sensor elements:

$$X=x_1,x_2,x_3,\ldots,x_n Y=y_1,y_2,y_3,\ldots,y_n Z=z_1,z_2,z_3,\ldots,z_n$$

Digital data in these vectors can be values taken from the analog waveform data at regular time intervals (e.g., generating a digital data point for every second of magnetic flux disturbance) or can be peak amplitude values derived from the analog waveform data. Other methods for deriving the digital data values from the analog waveform data also can be used. As will be appreciated by those skilled in the art, filtering and analog-to-digital conversion can be performed on collected data to generate each data vector. The waveform plots 610 for each dimensional axis begin before a train enters the range of the sensor device. The data plot for each of the dimensional axes between zero and 15 seconds is the baseline output from the sensor element when the Earth's magnetic field within sensor range is undisturbed by moving magnetic fields. The value of the baseline may be substantially different for each sensor element. The baseline value functions as a reference value for waveform processing and evaluation, for example providing a reference for differential and/or relative amplitude values used in generating a UTIS or similar data.

A train entering the sensing range of a sensor device causes measurable disturbance of the local magnetic field. Each sensor element's waveform response characteristics are determined by the orientation of the sensing element axis, the varying characteristics of the train's magnetic profile and the rate at which the train moves through the sensor device's range. Moving locomotives cause significant waveform variation 640 and the waveform shape is determined by the magnetic field generated by the locomotive and its traction motors, rate of movement and also by the configuration of the rest of the train. The waveform generated by a single locomotive is different than the waveform of the same locomotive coupled to a railcar. Sensor element waveforms generated by a train moving within range of a sensor device are determined by interaction of the individual magnetic fields generated by each train element including locomotives, rail cars and cargo, upon the sequential order of the elements and upon the rate at which the train moves through the sensor's range.

The waveform generated by the sensor elements in response to a train entering sensing range is depicted in FIG. 6. This waveform begins at 15 seconds elapsed time and ends at 175 seconds. Between zero and 15 seconds, the sensor elements' output waveforms are at baseline because the train is not within sensor range. Between 175 and 190 seconds, the sensor elements' output waveforms are again at baseline because the train has moved beyond sensor range. A detection event at the sensor device processor level establishes an event window 650 that includes the start, pendency and termination of the train event waveform. This example's detection process computes the waveform's standard deviation during a fixed time interval and compares it to a predefined threshold. This exemplary process also calculates the energy of the waveform and compares that to another predefined threshold. If $\overline{X}_k$ is the mean value of the waveform data taken over n samples $X_k$ while $\sigma_k$ is the standard deviation and $\underline{X}_k$ is the mean value over m number of samples such that m≥10n then a detection is declared if $$|\underline{X}_k-\overline{X}_k|>\tau_1 \text{ and } \sigma_k>\tau_2$$

where $\tau_1$, $\tau_2$ are the thresholds derived empirically from the actual train waveform data (e.g., from a noise level in the waveform data). The total calculated energy is based on the area under the curve. Energy threshold calculations enable the detection process to determine if the object causing a magnetic flux density change is train. Calculations in the rate of flux density change allow the detection process to determine if a train is moving or stopped.

AMR sensor elements are susceptible to saturation and disruption of the magnetic element domain alignment if exposed to large magnetic fields. If this occurs, the "unoccupied baseline" value remains shifted until the domain is realigned. If the baseline shift exceeds the detection threshold $\tau_1$, the sensor device will transmit data to the zone processor that will be evaluated as an occupied track when the track is, in fact, not occupied. Some embodiments address this issue by applying electronic set/reset pulses to the magnetic component of the sensor element to realign the magnetic domains. If the magnetic domains are successfully realigned, the baseline returns to the previous "unoccupied baseline" value.

Using train detection embodiments, it is important to define when a train detection event commences and when it ends because it is the data collected between commencement and termination that is used to uniquely identify specific trains that enter and exit detection zone. In some embodiments, criteria for commencing a train detection event require that a threshold is exceeded for a given period (e.g., for three consecutive detection time periods). If the threshold is not satisfied for a given period (e.g., five consecutive detection time periods), the train detection event has ended. This detection process embodiment can be based on waveform data from a one-dimensional or multi-dimensional sensor element.

Figure 7:
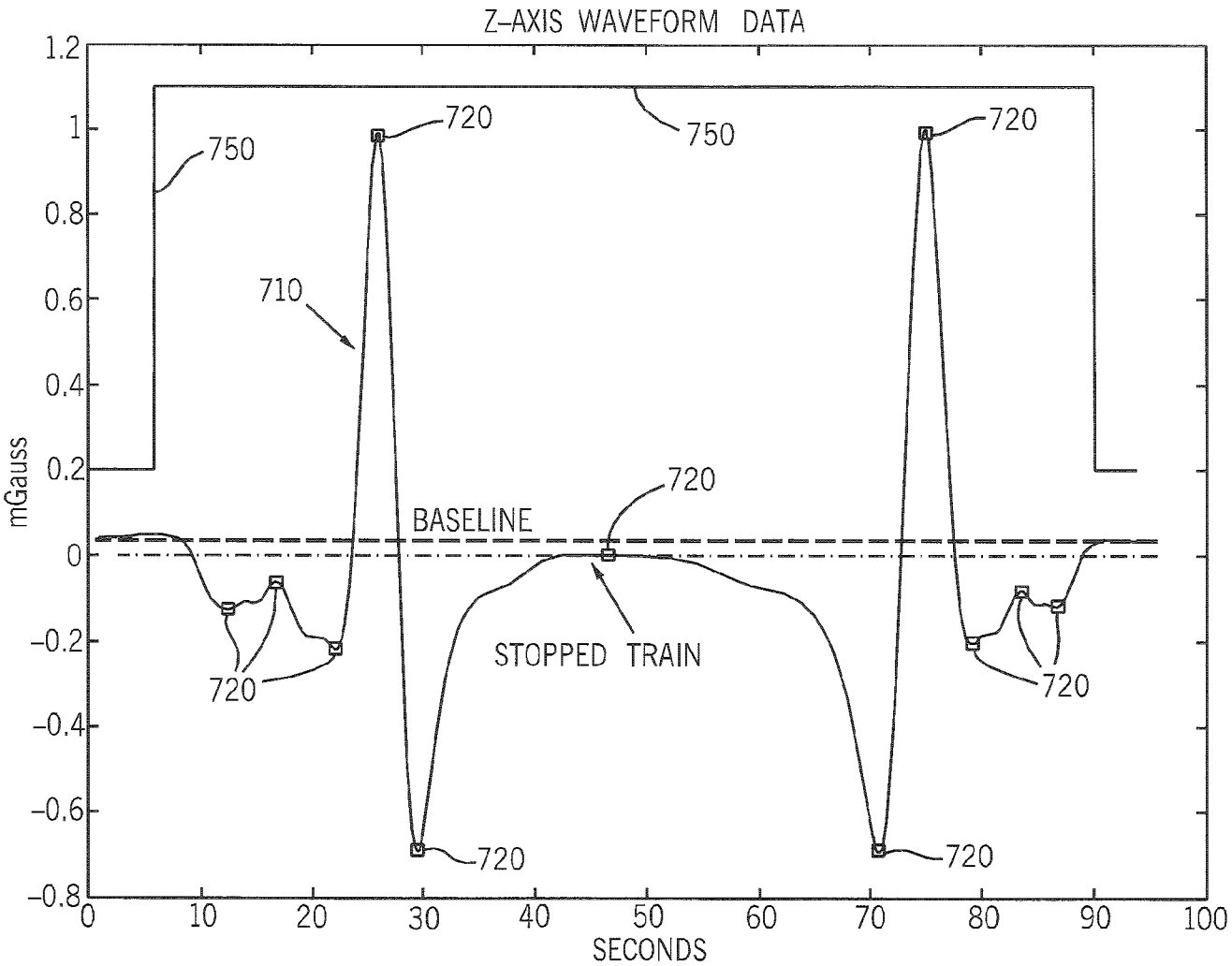
FIG. 7 is a data plot showing data collected from a one-dimensional sensor element measuring magnetic flux density in a detection zone in which a train has entered, stopped and backed up in one or more train detection embodiments according to one or more embodiments of the present invention.

Detailed features can be extracted or derived from train event waveform data. Three-dimensional sensor element data allows multi-variable digital conversion of the analog data, enabling a composite analysis sufficient to examine and extract waveform features needed for object classification and allowing adequate feature extraction for reliable train identification in unstable magnetic environments. Feature extraction processes in some embodiments extract salient features from the train detection waveform. These extracted/derived features can be used for train identification and other purposes. FIG. 7 shows one-dimensional waveform data 710 generated by a train consisting of a locomotive coupled to one car moving within range of a sensor device. The horizontal axis of the plot displays elapsed time in seconds and the vertical axis displays mGauss values of the sensor element waveform. The figure displays the following events:

(1) 00 to 08 seconds—sensor waveform at baseline, no train within sensor range (2) 08 to 40 seconds—train enters sensor range, railcar first, then locomotive (3) 40 to 52 seconds—train stops within sensor range, locomotive near sensor, sensor waveform offset from baseline value (4) 52 to 90 seconds—train reverses direction, locomotive first, then railcar (5) 90 to 93 seconds—train moves beyond sensor range, sensor waveform returns to baseline FIG. 7 shows the waveform data representing this train is shown as amplitude variations (vertically positive and negative). The largest amplitude values correspond to the locomotive's magnetic field. Variations corresponding to the railcar are noticeably smaller. The essentially flat portion of the waveform between 40 and 52 seconds indicates the detected train has stopped within range of the sensor device. This is confirmed by comparing the mGauss value of the waveform during this time to the base line value of the waveform before a train entered the sensor's range. The waveform data is consistent with the train reversing its direction of movement beginning at 52 seconds and continuing this movement beyond the sensor's range at 90 seconds. Comparing the waveform between 8 and 40 seconds with the waveform between 52 and 90 seconds confirms that the waveforms are approximate mirror images of each other. This is consistent with waveforms generated by movements of the same object in opposite directions. Small differences in the mirror waveforms are likely due to track speed variations between the train decelerating to a stop in a first direction and accelerating from a stop in the opposite direction. Although the forward and reverse waveforms are not identical, this one dimensional waveform data is sufficient to extract unique elements necessary to accurately decipher actual train movements.

Embodiments of this method include the analysis of a variety of waveform features, including number, magnitude, slope and sequence of waveform peak values. Waveform peak features are determined by comparing maximum and minimum waveform values with the measured variation or offset of the baseline value. Frequency of the waveform may be obtained by calculating a Fourier transform of the time domain waveform data. Because waveform frequency is a function of train speed, frequency features can provide useful dynamic speed and acceleration data when comparing this feature across multiple sensor devices having known locations. A significant advantage of deriving (or extracting) and using flux density magnitude peak values from sensor element waveform features is that peak values relative to a known baseline value or offset do not change as train speed changes. Such speed-independent waveform data peaks compress or expand in the time domain as train speed changes, but such peaks' sequence and magnitude values are not affected by the expansion or contraction of the waveform within the speed range of modern trains. Compared to waveform analytic methods that correct for frequency variation, waveform peak value data analysis is efficient (requiring reduced data storage, data transmission time, and simplifying data processing, evaluation, and comparison).

Exemplary peak detection and mapping process results are shown in FIG. 7. Squares 720 falling within the event window 750 identify peak locations from which peak amplitude values can be derived and expressed in digital waveform data samples ($z_1$, $z_2$, $z_3$, . . . , $z_n$). While train detection is in progress, peak values $p_i$ can be calculated using a peak detection threshold δ (e.g., a standard deviation minimum deviation value), as shown in the exemplary process illustrated in FIG. 9. The series of detected peak amplitude values for a given train detection event can then be given by:

$$P=p_1,p_2,p_3, \ldots ,p_n$$

The sequence and time-stamped peak amplitude values of a digitally converted waveform produced by a train as it moves through the range of a sensor device may be calculated and stored by the sensor device. Time-stamped train detection event and associated peak value data is transmitted to the zone processor by every sensor device assigned to a given detection zone. Any required further processing of peak value data can be performed by the sensor device and/or by the zone processor. This processing extracts and distinguishes the unique train identification waveform data from the train event waveform. These waveforms may be substantially identical or significantly different depending upon the actual movements of the train within the range of the detection zone sensors. Train movements can range from a simple unidirectional pass through a detection zone to a series of forward and reverse movements with stops in between. The flexibility of the feature extraction process must accommodate the fact that there is no real limit to the number of times a train may stop or move in either direction within range of a sensor device.

A method of detecting a train stop examines waveform variation and compares consecutive waveform data changes to a threshold change limit while comparing the largest difference in variation to another predefined threshold. If $\overline{X}_k$ is the mean value of the waveform data taken over n samples and $\overline{X}_k$ its derivative, then the following process steps can be used to determine a train's motion using comparisons to thresholds $\delta_1$ and $\delta_2$ over M number of derivatives. The thresholds $\delta_1$ and $\delta_2$ are derived empirically from actual train waveform data.

$$\text{Let } \overline{X}_k = 1\Big/n\left(\sum^{n} x_i\right)$$

$$\sum^{M}\left(\overline{X}'_k > \delta_1\right) > M \;\;\&\;\; \max(\overline{X}'_k) - \min(\overline{X}'_k) \geq \delta_2$$

vehicle in motion $$\sum^{M}\left(\overline{X}'_k > \delta_1\right) < M \;\;\&\;\; \max(\overline{X}'_k) - \min(\overline{X}'_k) \leq \delta_2$$

vehicle standing still

Once the train's motion is determined, waveform data peak redundancies may be identified and removed with additional processing. Applying this method to the data of FIG. 7 will detect a train stop (between 40 and 55 seconds). The waveform baseline is the reference for this detection. Identifying train stop events and baseline events facilitates grouping waveform peak data between these events to detect waveform peak data events that are consistent with a train reversing its movement within range of a sensor device. Generally, the sequence of peak values detected for a train detection event can be represented by:

$$P=p_{11},p_{12},p_{13}\ldots,p_{1n_1},p_{21},p_{22},p_{23},\ldots,p_{2n_2},p_{m1},p_{m2},p_{m3},\ldots,p_{mn_m}$$

where m is the number of stops made by the train in a particular train detection event and $n_i$ is the number of peaks detected in the interval before an $i^{th}$ stop. These sub-groups may be compared to determine degree of match.

In some embodiments, dynamic time warping (DTW) processing methods evaluate degree of match between a first subgroup of waveform peaks with one or more neighboring subgroups. The concept is illustrated as follows, given two subgroups of peaks in a larger group of peaks for any particular waveform:

$$P_1=p_{11},p_{12},\ldots,p_{1n_1}P_2=p_{21},p_{22},\ldots,p_{2n_2}$$

where $n_1$=M and $n_2$=N, the DTW process gives the optimal solution in the O(MN) time. If these peaks or sequences are taken from some feature space Φ then for comparison purposes a local distance (d) measure between $P_1$, $p_2 \epsilon \Phi$ can be given by:

$$d:\Phi\times\Phi\rightarrow\Re_{\geq 0}$$

For similar peaks, d will be small; for dissimilar peaks, d will be large. The Dynamic Programming algorithm lies at the core of DTW, therefore the above distance function can be called a cost function and hence it becomes a cost minimization task. The main algorithm creates a distance matrix $C\epsilon\Re^{N\times M}$ representing all pair wise distances between $P_1$ and $P_2$. C is also called local cost matrix for the alignment of two sequences $P_1$ and $P_2$:

$$C\epsilon\Re^{N\times M}:c_{ij}=|p_{1i}-p_{2j}|,i\epsilon[1:N],j\epsilon[1:M]$$

After populating the local cost matrix find the alignment path that follows the low cost area of the cost matrix. The alignment path built by DTW is a sequence of points $w=w_1, w_2, \ldots, w_K$ with $$w_l=(w_i,w_j)\epsilon[1:N]\times[1:M] \text{ for } l\epsilon[1:K]$$

satisfying the following criteria:

(1) Boundary condition such that the starting and ending points of the warping path must be first and last points of aligned sequence, that is $$p_1=(1,1) \text{ and } p_k=(N,M);$$

(2) Monotonicity condition for preserving time sequence of points/peaks (sequences are considered in the same order);

(3) Step size condition for limiting the warping path from long jumps while aligning sequences, normally using a basic step size as $p_{l+1}p_l\epsilon\{(1,1),(1,0),(0,1)\}$.

The cost function will be:

$$c_p(P_1, P_2) = \sum_{l=1}^{L} c(p_{1il}, p_{2jl})$$

The path that has a minimal associated cost is the optimal warping path called W*. In order to find this optimal path every possible warping path between $P_1$ and $P_2$ has to be explored which could be computationally expensive. A Dynamic Programming based method which reduces the complexity down to O(MN) can be employed which uses the DTW distance function:

$$DTW(P_1,P_2)=c_{p^*}(P_1,P_2)=\min\{c_p(P_1,P_2),p\epsilon P^{N\times M}\}$$

where $P^{N\times M}$ is set of all possible warping paths. The global cost matrix D can now be created such that:

Row 1 is given by $D(1,j)=\Sigma_{k=1}^{j}c(p_1,p_{2k})$, $j\epsilon[1,M]$

Column 1 is given by $D(i,1)=\Sigma_{k=1}^{i}c(p_{1k},p_2)$, $i\epsilon[1,N]$

Remaining elements are given by:

$$D(i,j)=\min\{D(i-1,j-1),D(i-1,j),D(i,j-1)\}+c(p_{1i},p_{2j}),i\epsilon[1,N],j\epsilon[1,M]$$

The time cost of building this matrix is O(NM). Once the matrix is populated, the warping path could be found by simply moving forward from point $w_{start}(1,1)$ to $w_{end}(M,N)$.

Figure 8:
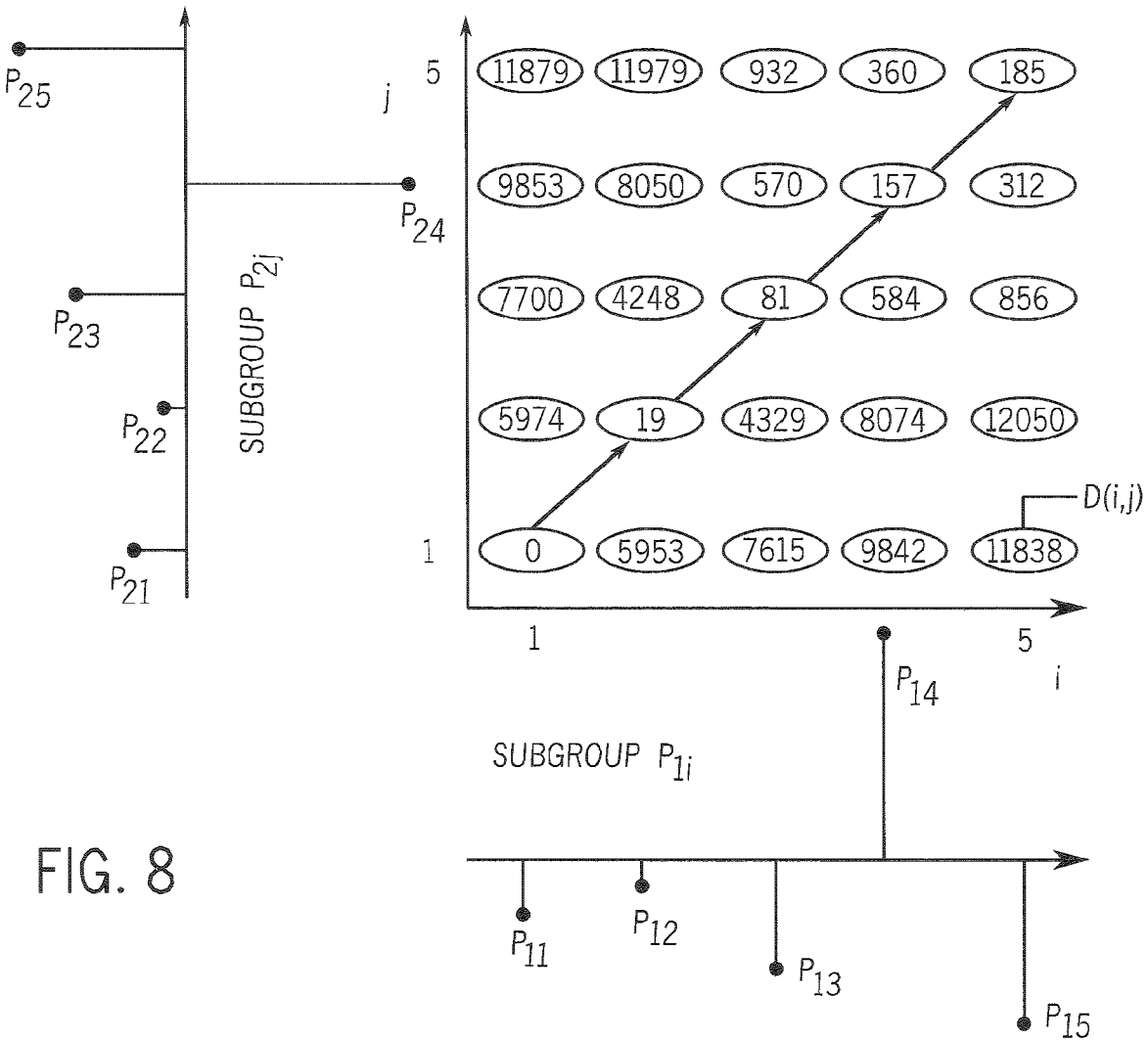
FIG. 8 illustrates an optimal warping path embodiment for the train event of FIG. 7.

FIG. 8 shows a cost matrix calculated for the waveform data and peaks shown in FIG. 7. Subgroup $P_{1i}$ is illustrated by the horizontal line diagram of vector values for the waveform peak data subgroup (see FIG. 7 at 8 to 40 seconds elapsed time) that is bounded by the base line reference (see FIG. 7 at 0 to 8 seconds elapsed time) and the train stop (see FIG. 7 at 40 to 52 seconds elapsed time). Subgroup $P_{1j}$ is illustrated by the vertical line diagram of vector values for the waveform peak data subgroup (see FIG. 7 at 52 to 90 seconds elapsed time) that is bounded by the train stop (see FIG. 7 at 40 to 52 seconds elapsed time) and the base line reference (see FIG. 7 at 90 to 95 seconds elapsed time). The subgroup values are compared to populate the matrix which is then evaluated to determine lowest cost. The optimal warping path, that is, the lowest cost associated, is shown by solid arrows. Once the warping path has been established, degree of match between the two subgroups must be determined. The peak detection process illustrated in FIG. 9 must accommodate waveform variations while determining an accurate match. The process identifies sequences of consecutive low cost matches between two subgroups. Once a minimum number are identified, the process illustrated in FIG. 10 determines if a match is found. This process is able to determine if a train has reversed its direction of travel after stopping by matching one subgroup of peaks with a mirror image of a neighboring subgroup.

Figure 11:
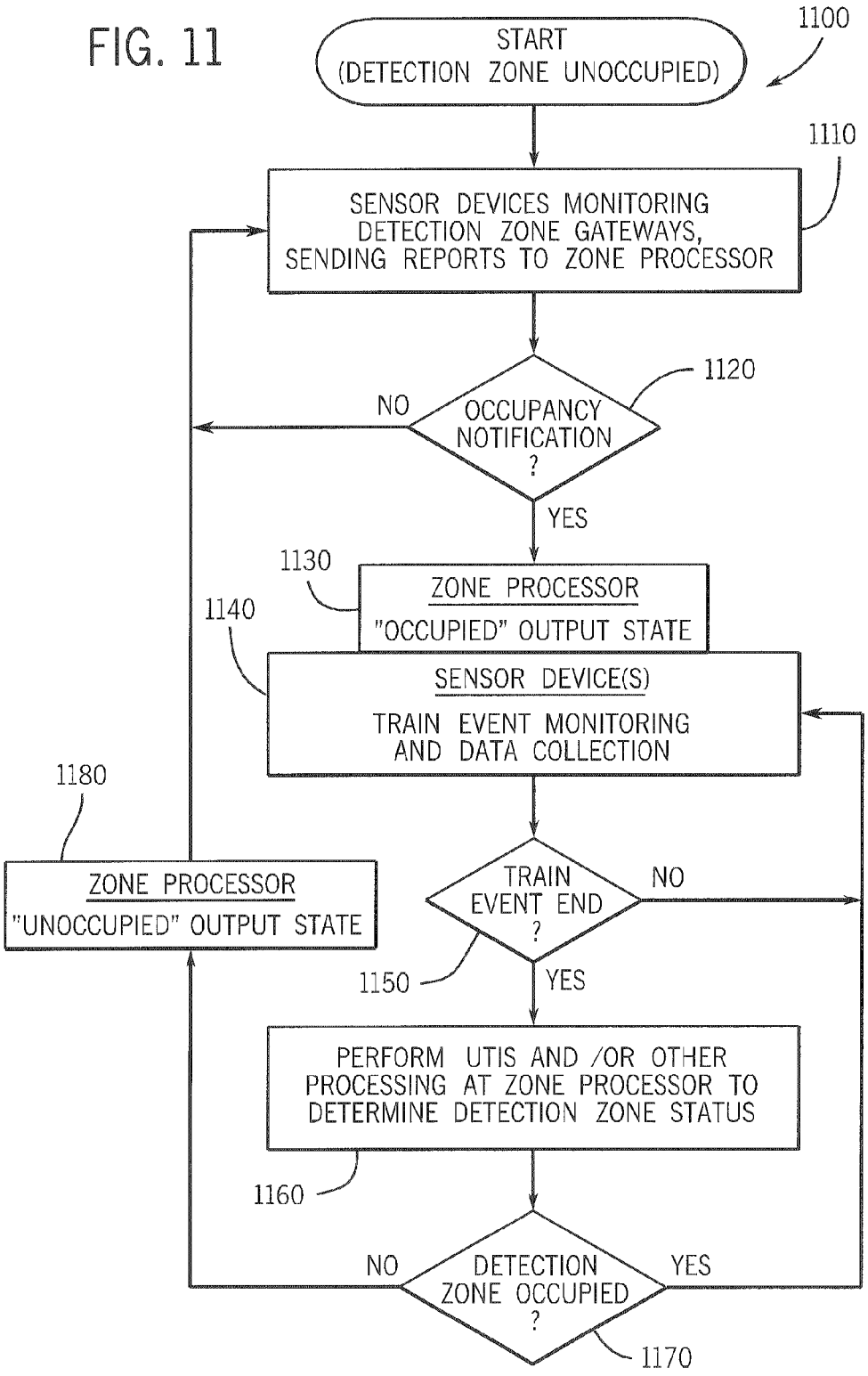
FIG. 11 is a flow diagram of one or more method embodiments for train detection according to one or more embodiments of the present invention.

One or more embodiments of methods according train detection embodiments herein can be seen in FIG. 11 (other method-related embodiments are shown and disclosed herein as well). Train detection 1100 begins with an unoccupied detection zone. At 1110 sensor devices begin monitoring detection zone gateways. When no train is detected in a given sensor device's sensing range, a time-stamped "NO EVENT" message is transmitted by each sensor device to the zone processor, for example once per second or on some other periodic basis; this allows the zone processor to monitor the operational status of all sensor devices serving the detection zone to help ensure vitality of the system. If a gateway sensor device detects a train, then the message to the zone processor changes at 1120, providing notification of at least partial occupancy of the detection zone by a detected train. If no train is detected, then 1120 returns to 1110 to continue monitoring the detection zone and sending "NO EVENT" messages. The message sent by a sensor device to the zone processor can be one or more of a variety of message types (e.g., a simple "OCCUPIED" notice, a preselected data payload, digital waveform data derived from analog waveform data generated by sensor device sensor elements, etc.). The zone processor changes it output state from "UNOCCUPIED" to "OCCUPIED" at 1130. At the same time one or more of the sensor devices monitor the pending train event and collect/generate data regarding that event at 1140. If the end of a train event is reached then at 1150 the zone processor can perform matching or other processing at 1160 (e.g., using UTIS and/or other data) to decide at 1170 whether the detection zone is still occupied. If the detection zone is deemed unoccupied, then the zone processor output state changes back to "UNOCCUPIED" at 1180 and the system reverts to 1110 with the gateway sensor devices monitoring detection zone gateways and sending "NO EVENT" messages to the zone processor. If at 1150 the train event is determined to be ongoing, then it does so at 1140. At 1170, if the zone processor determines that the detection zone is still occupied by all or part of a previously-detected and identified train, then it too allows the detection zone sensor devices to continue at 1140. As will be appreciated by those skilled in the art, digital waveform data generated in the sensor devices can be sent piecemeal to the zone processor to allow further processing of a complete train event at the zone processor. In other embodiments, the train event detected by a given sensor device might be allowed to finish so that the sensor device can process the complete event's digital waveform data; UTIS and/or other data can then be sent to the zone processor. A variety of processing schemes are thus available according to the train detection embodiments disclosed herein.

Due to the empirical peak detection threshold δ and changing magnetic flux within sensor range, the number and magnitude of peaks detected, even for an identical portion or segment of a train, may be different. Complexity of this task is increased by the fact that the two waveform peak subgroups may differ due to the number of railcars they represent. For example, one subgroup could represent a partial forward movement of five railcars while the other subgroup could represent a partial reverse movement of ten railcars.

Many features and advantages of the invention are apparent from the written description, and thus, the appended claims are intended to cover all such features and advantages. Further, numerous modifications and changes will readily occur to those skilled in the art, so the present invention is not limited to the exact operation and construction illustrated and described. Therefore, described embodiments are illustrative and not restrictive, and the invention should not be limited to the details given herein but should be defined by the following claims and their full scope of equivalents, whether foreseeable or unforeseeable now or in the future.

What is claimed is:

1. A train detection system for detecting trains and determining the occupancy of a railroad track detection zone, the detection zone comprising one or more railroad track segments and a plurality of access points constituting all points of train entry into and exit from the railroad track detection zone, the system comprising:

a zone processor;

a plurality of sensor devices fixed adjacent to the track at each access point, wherein each sensor device comprises:

a power supply;

one or more anisotropic magnetoresistive (AMR) sensor elements powered by the power supply and configured to generate analog waveform data representative of detected trains entering or exiting the detection zone on the track, the waveform data further being representative of the effect of each detected train on the Earth's magnetic field;

a sensor device processor powered by the power supply and coupled to each sensor element, wherein the sensor device processor is configured to process analog waveform data generated by each sensor element and to generate time-stamped digital train event data comprising unique train identification signature (UTIS) data, the UTIS data comprising peak amplitude values in a sequence representing the sequence of the peak amplitude values in the time-stamped digital train event data;

spread spectrum wireless communication apparatus coupled to the sensor device processor, wherein the communication apparatus is configured to transmit time-stamped digital train event data to the zone processor and is further configured to maintain a vital communications link between the sensor device and the zone processor;

wherein the zone processor is configured to perform matching evaluation of the UTIS data transmitted to the zone processor by the plurality of sensor devices to generate an output state indicative of whether the railroad track detection zone is occupied or unoccupied by a train by determining whether the detection zone is clear of any whole or partial train previously detected entering the detection zone.

2. The system of claim 1 wherein analog waveform data generated by the one or more AMR sensor elements is multidimensional analog waveform data.

3. The system of claim 2 further comprising a warning signal coupled to the zone processor to signal occupancy of the detection zone when the zone processor output state indicates the presence of a whole or partial train in the detection zone.

4. The system of claim 3 wherein the zone processor comprises a vital processing device comprising two independent, identical processing units that operate so that the zone processor output state indicates an occupied detection zone when any zone processor component fails to or is unable perform an intended function and so that power source and return connections to the two independent, identical processing units are isolated and separate; and wherein the sensor devices are paired to provide independent and redundant data collection and evaluation that satisfy closed circuit and fail-safe principles.

5. The system of claim 4 wherein the sensor device power supply is at least one of the following: self-sustaining; self-recharging; an energy harvesting apparatus.

6. The system of claim 5 wherein the sensor device further comprises one or more set/reset controls to realign magnetic domains of one or more sensor elements.

7. The system of claim 6 wherein the UTIS data is determined using a peak detection threshold empirically obtained from a noise level in the waveform data.

8. A method for determining the occupancy status of a railroad track detection zone by monitoring movement of trains into and out of the detection zone, wherein the detection zone comprises a railroad track section having a plurality of access points through which trains pass into and out of the detection zone, further wherein the detection zone comprises a zone processor communicatively coupled by a wireless communication system to a plurality of gateway sensor devices fixed adjacent to each detection zone access point, wherein each sensor device has a sensing range that includes a portion of the railroad track at the adjacent access point and further wherein each sensor device comprises one or more anisotropic magnetoresistive (AMR) sensor elements configured to generate analog waveform data representing magnetic characteristics of a train within the sensor device sensing range, the method comprising:

each sensor device AMR sensor element generating analog waveform data representing magnetic characteristics of a train within the sensor device sensing range;

converting the generated analog waveform data to digital waveform data;

each sensor device processing the digital waveform data to generate time-stamped unique train identification signature (UTIS) data, wherein processing the digital waveform data comprises:

detecting amplitude peaks in the digital waveform data;

constructing a set, vector or matrix of amplitude peak magnitude values in a sequence representing the sequence of the amplitude peak values in the digital waveform data;

each sensor device transmitting UTIS data to a zone processor;

the zone processor performing matching evaluation of UTIS data transmitted by the sensor devices to determine whether the detection zone is unoccupied or occupied by a whole or partial train;

wherein all sensor devices and the zone processor maintain a vital communications protocol, and further wherein the combined sensing ranges of all sensor devices does not cover the entire length of railroad track in the detection zone.

9. The method of claim 8 wherein the zone processor controls a railroad crossing signal or a warning signal based on the determination of whether the detection zone is unoccupied or occupied by a train.

10. The method of claim 9 wherein converting generated analog waveform data is performed by an amplifier and an analog-to-digital converter (ADC) coupled to one or more sensor elements in each sensor device.

11. The method of claim 10 wherein detecting peak amplitudes in the digital waveform data uses a peak detection threshold empirically obtained from a noise level in the waveform data.

12. The method of claim 11 wherein the zone processor processes UTIS data transmitted by the sensor devices using two independent, identical processing units that operate so that the zone processor output state indicates an occupied detection zone when any zone processor component fails to or is unable perform an intended function and so that power source and return connections to the two independent, identical processing units are isolated and separate; and wherein the sensor devices are paired to provide independent and redundant data collection and evaluation that satisfy closed circuit and fail-safe principles.

13. A train detection system for detecting a train in a railroad track train detection zone comprising three railroad track detection sub-zones comprising a railroad track passing through a first approach detection sub-zone, an island detection sub-zone, and a second approach detection sub-zone, the system comprising:

a plurality of gateways comprising a first gateway defined by a first end of the railroad track detection zone and a collocated end of the first approach detection sub-zone, a second gateway defined by the interface between the first approach detection sub-zone and the island detection sub-zone, a third gateway defined by the interface between the island detection sub-zone and the second approach detection sub-zone, and a fourth gateway defined by a second end of the railroad track detection zone and a collocated end of the second approach detection sub-zone;

a zone processor;

a plurality of sensor devices mounted adjacent to the track at each gateway and within sensor device sensing range, wherein each sensor device comprises:

one or more sensor elements configured to generate analog waveform data representative of trains passing one of the gateways on the track, the waveform data further being representative of a train's effect on the Earth's magnetic field;

sensor device processor apparatus coupled to each sensor element, wherein the sensor device processor apparatus is configured to process analog waveform data generated by each sensor element and to generate time-stamped digital train event data;

communication apparatus coupled to the sensor device processor apparatus, wherein the communication apparatus is configured to transmit time-stamped digital train event data to the zone processor;

wherein the zone processor is configured to evaluate time-stamped digital train event data transmitted to the zone processor by the plurality of sensor devices to generate an output state indicative of whether the railroad track detection zone is occupied or unoccupied by a train.

14. The system of claim 13 wherein each communication apparatus is configured to comply with a vital communication protocol.

15. The system of claim 14 wherein each sensor device further comprises a power supply.

16. The system of claim 15 wherein each power supply is at least one of the following: self-sustaining; self-recharging; an energy harvesting apparatus.

17. The system of claim 16 wherein the zone processor is configured to implement dynamic time warping to evaluate degree of match between first UTIS data and second UTIS data, wherein the first UTIS data comprises data transmitted to the zone processor by a first sensor device and further wherein the second UTIS data comprises data transmitted to the zone processor by a second sensor device.

18. The system of claim 16 wherein the zone processor is configured to implement dynamic time warping to evaluate degree of match between first UTIS data and second UTIS data, wherein the first UTIS data comprises data transmitted to the zone processor by a first sensor device and further wherein the second UTIS data comprises data transmitted to the zone processor by the first sensor device.

19. The system of claim 16 further comprising a railroad signaling device communicatively coupled to the zone processor, wherein the signaling device provides a warning signal when the zone processor output state indicates that the railroad track detection zone is occupied.

20. The system of claim 16 wherein each sensor element comprises an anisotropic magnetoresistive (AMR) sensor configured to generate one of the following:

one-dimensional analog waveform data, two-dimensional analog waveform data, three-dimensional analog waveform data.

* * * * *